US011757218B2

(12) United States Patent
Hosoda

(10) Patent No.: US 11,757,218 B2
(45) Date of Patent: Sep. 12, 2023

(54) CONNECTOR FITTING, CONNECTOR TERMINAL, CONNECTOR ADDITIONAL MEMBER, RECEPTACLE CONNECTOR, PLUG CONNECTOR, CONNECTOR AND CONNECTOR MANUFACTURING METHOD

(71) Applicant: HIROSE ELECTRIC CO., LTD., Kanagawa (JP)

(72) Inventor: Shohei Hosoda, Kanagawa (JP)

(73) Assignee: HIROSE ELECTRIC CO., LTD., Kanagawa (JP)

( * ) Notice: Subject to any disclaimer, the term of this patent is extended or adjusted under 35 U.S.C. 154(b) by 62 days.

(21) Appl. No.: 17/395,095

(22) Filed: Aug. 5, 2021

(65) Prior Publication Data

US 2022/0052470 A1 Feb. 17, 2022

(30) Foreign Application Priority Data

Aug. 17, 2020 (JP) ..... 2020-137239

(51) Int. Cl.
*H01R 12/71* (2011.01)
*H01R 13/629* (2006.01)
(Continued)

(52) U.S. Cl.
CPC ..... *H01R 12/716* (2013.01); *H01R 12/7005* (2013.01); *H01R 13/405* (2013.01);
(Continued)

(58) Field of Classification Search
CPC ..... H01R 12/716; H01R 12/7005; H01R 13/405; H01R 13/629; H01R 43/16; H01R 43/24; H01R 12/707; H01R 12/73; H01R 13/02; H01R 12/70; H01R 13/46; H01R 13/639; H01R 12/71
See application file for complete search history.

(56) References Cited

U.S. PATENT DOCUMENTS 5,915,975 A * 6/1999 McGrath ..... H01R 12/716 439/74
9,543,675 B1 * 1/2017 Takenaga ..... H01R 13/635
(Continued)

FOREIGN PATENT DOCUMENTS

JP 2019036500 A 3/2019
JP 2020-31025 A 2/2020
JP 2020091950 A 6/2020

OTHER PUBLICATIONS

Japanese Office Action (JPOA) dated Jun. 15, 2023, for the corresponding Japanese Patent Application No. 2020-137239 and its English machine translation.

*Primary Examiner* — Abdullah A Riyami
*Assistant Examiner* — Nelson R. Burgos-Guntin
(74) *Attorney, Agent, or Firm* — Rankin, Hill & Clark LLP

(57) ABSTRACT

Provided is a connector fitting which includes: a fixed portion provided on a side wall of a housing of a connector; and a projecting portion provided on the side wall of the housing and projecting from the side wall of the housing with respect to the fixed portion, in which the fixed portion is wider than the projecting portion, the fixed portion includes a pair of shoulder portions on both side surfaces of the fixed portion, and the shoulder portions are provided on a side surface between the fixed portion and the projecting portion.

9 Claims, 18 Drawing Sheets

(51) Int. Cl.

| | |
|---|---|
| ***H01R 43/16*** | (2006.01) |
| ***H01R 12/70*** | (2011.01) |
| ***H01R 43/24*** | (2006.01) |
| ***H01R 13/405*** | (2006.01) |

(52) U.S. Cl.
CPC ..... *H01R 13/629* (2013.01); *H01R 43/16* (2013.01); *H01R 43/24* (2013.01)

(56) References Cited

U.S. PATENT DOCUMENTS

| | | | | |
|---|---|---|---|---|
| 10,741,956 | B2 * | 8/2020 | Matsuno | H01R 13/115 |
| 10,931,049 | B2 | 2/2021 | Kobayashi | |
| 2013/0012039 | A1 * | 1/2013 | Nose | H01R 12/716 439/74 |
| 2015/0099387 | A1 * | 4/2015 | Takemoto | H01R 13/627 439/682 |
| 2017/0271813 | A1 * | 9/2017 | Ge | H01R 13/504 |
| 2018/0069331 | A1 * | 3/2018 | Hirakawa | H01R 12/707 |
| 2018/0175561 | A1 * | 6/2018 | Chen | H01R 12/52 |
| 2019/0131731 | A1 * | 5/2019 | Lee | H01R 13/405 |
| 2020/0067217 | A1 * | 2/2020 | Ashibu | H01R 12/716 |
| 2020/0176909 | A1 | 6/2020 | Kobayashi | |
| 2020/0295484 | A1 * | 9/2020 | Kobayashi | H01R 12/716 |
| 2021/0066854 | A1 * | 3/2021 | Hosoda | H01R 13/2407 |
| 2021/0111506 | A1 * | 4/2021 | Kobayashi | H01R 12/716 |
| 2021/0119386 | A1 * | 4/2021 | Lee | H01R 12/716 |
| 2021/0167532 | A1 * | 6/2021 | Ashibu | H01R 13/631 |
| 2022/0052468 | A1 * | 2/2022 | Chang | H01R 12/716 |
| 2022/0052470 | A1 * | 2/2022 | Hosoda | H01R 43/16 |
| 2022/0094112 | A1 * | 3/2022 | Kim | H01R 12/707 |
| 2022/0131306 | A1 * | 4/2022 | Kobayashi | H01R 13/504 |
| 2022/0239025 | A1 * | 7/2022 | Kobayashi | H01R 13/502 |
| 2022/0271455 | A1 * | 8/2022 | Meng | H01R 13/629 |

* cited by examiner

CONNECTOR FITTING, CONNECTOR TERMINAL, CONNECTOR ADDITIONAL MEMBER, RECEPTACLE CONNECTOR, PLUG CONNECTOR, CONNECTOR AND CONNECTOR MANUFACTURING METHOD

CROSS-REFERENCE TO RELATED APPLICATION

This application claims priority from Japanese Patent Application No. 2020-137239 filed with the Japan Patent Office on Aug. 17, 2020, the entire content of which is hereby incorporated by reference.

BACKGROUND

1. Technical Field

The present disclosure relates to a connector fitting, a connector terminal, a connector additional member, a receptacle connector, a plug connector, a connector and a connector manufacturing method.

2. Related Art

When manufacturing a connector including a housing that holds a fitting such as a metal member with a plurality of terminals and locking mechanisms, a structure of the fitting suitable for insert molding (integral molding) between various fittings and the housing is desired. Specifically, the structure of the fitting such as the metal member suitable for covering a part of the fitting as designed is desired. More specifically, when manufacturing the connector, various fittings are fixed to a mold, and when resin, which is an insulator for molding the housing, is poured into the mold, the structure of the fitting that suppresses inflow of the resin to an unintended position is desired.

As a substrate connection connector for connecting substrates in which a plurality of terminals are arranged and held in a housing by insert molding (integral molding) or the like, for example, there is a connector disclosed in JP-A-2020-031025. The connector includes a connector (plug connector) on a plug side and a connector (receptacle connector) on a receptacle side connected to the connector on the plug side, and has a rectangular housing in which the terminals are arranged and held in a longitudinal direction.

The plug connector and the receptacle connector can be provided on a printed wiring board, a flexible flat cable, or the like. For example, the substrates can be connected by fitting the receptacle connector, which is provided on the printed wiring board by surface mounting or the like, and the plug connector, which is provided at an end of the flexible flat cable, to each other.

In order to maintain a state in which the connectors are connected to each other, each connector has a structure in which the connectors are fitted to each other. For example, in JP-A-2020-031025 described above, in addition to the terminals, the plug connector and the receptacle connector include metal members on both sides in the longitudinal direction with a row of the terminals therebetween. A projecting additional member is provided on a part of the metal member facing an inside of the receptacle connector, and a recess is provided on a part of the metal member facing an outside of the plug connector. When the connectors are fitted to each other, the projecting additional member fits into the recess, so that the metal member of the plug connector and the metal member of the receptacle connector can be maintained in an electrically connected state.

The metal members such as the terminals are embedded and held in the housing of such a plug connector and a receptacle connector by insert molding. In insert molding, the terminals are arranged in a direction that can be the longitudinal direction of the housing by the mold, a fixing jig, or the like, and the metal members (additional members) or the like having a locking mechanism are arranged at both ends in the longitudinal direction. Subsequently, by pouring the resin, which is the insulator, into a space defined by the mold, a part of the fitting such as the terminal and additional member is covered with the resin. Finally, by curing the resin, the housing is formed in which the fittings such as the terminals and additional members are embedded and held.

In order to prevent a portion of the fittings such as the terminals and additional members exposed from the resin of the housing from being covered with the resin during insert molding, the inflow of the resin is suppressed by the mold, the fixing jig, or the like. In this way, by controlling flow of the resin on surfaces of the fittings such as the terminals and additional members by the mold, the fixing jig, or the like made based on design of the housing, a portion in which the surface of the fitting is covered with the resin and a portion in which the surface of the fitting is exposed from the resin can be formed separately in the housing.

SUMMARY

A connector fitting according to the present embodiment includes: a fixed portion provided on a side wall of a housing of a connector; and a projecting portion provided on the side wall of the housing and projecting from the side wall of the housing with respect to the fixed portion, in which the fixed portion is wider than the projecting portion, the fixed portion includes a pair of shoulder portions on both side surfaces of the fixed portion, and the shoulder portions are provided on a side surface between the fixed portion and the projecting portion.

DETAILED DESCRIPTION

Figure 1:
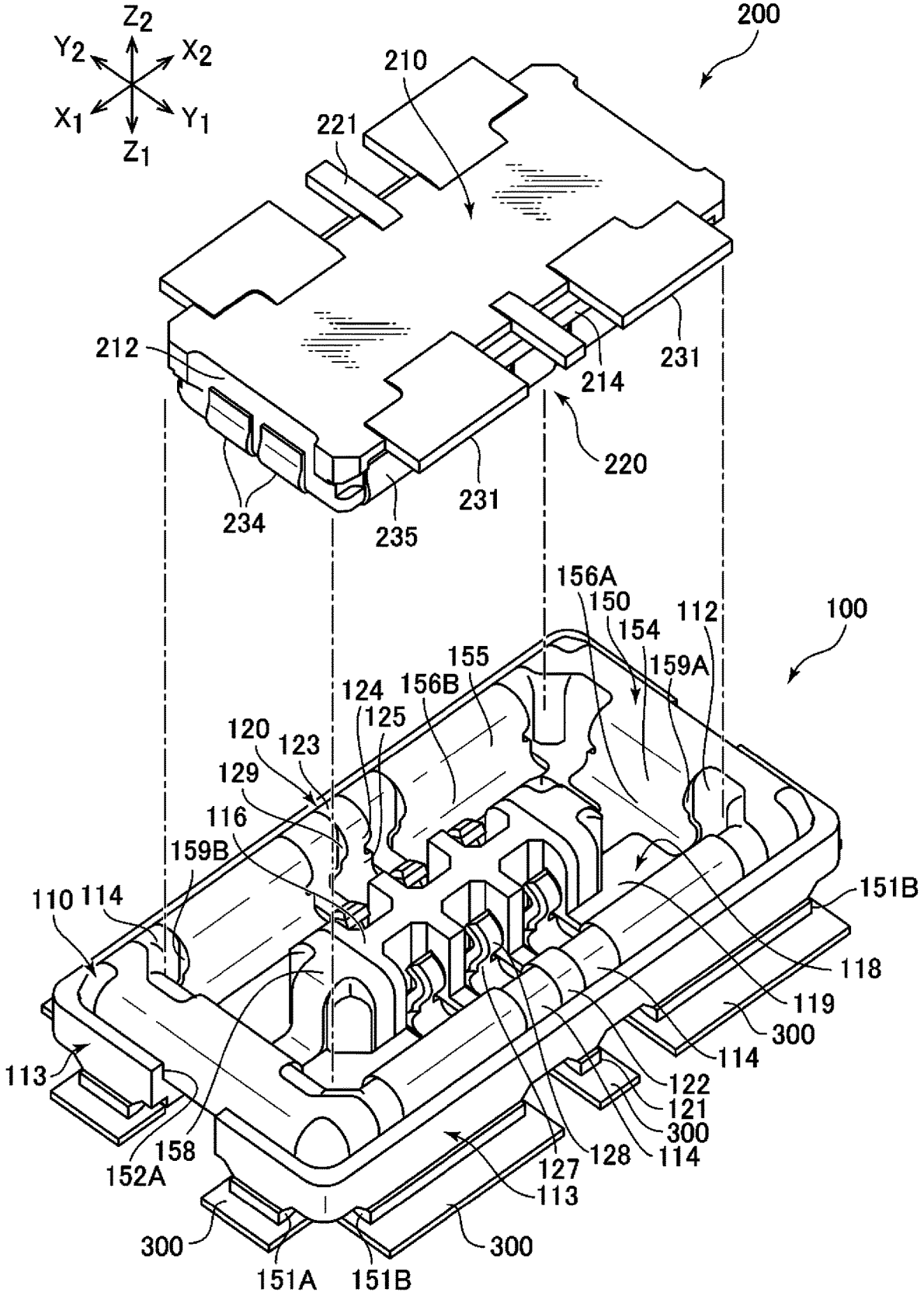
FIG. 1 is a perspective view of a plug connector and a receptacle connector according to an embodiment of the present disclosure as viewed from the plug connector side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, a plug connector and a receptacle connector that connect substrates are mounted on the substrates in a small electronic device such as a smartphone or a mobile terminal. Therefore, the plug connector and the receptacle connector are very small connectors. Fittings such as a plurality of terminals and other metal members that are parts of the plug connector and the receptacle connector are also very small. The smaller a size of the connector, the more difficult it is to hold and fix the terminals with a mold, a fixing jig, or the like, and to form a housing as designed by insert molding. For example, if the fittings themselves such as the terminals and other metal members embedded in the housing are small, when insert molding the fittings such as the terminals and other metal members, and the housing, it may not be possible to sufficiently cover a part of the terminal and the fitting to be exposed from the housing with the mold, the fixing jig, or the like without any gap. In that case, it is not possible to sufficiently suppress inflow of resin to the part of the terminal and the fitting to be exposed from the housing.

For example, in the terminals embedded in the housing of the receptacle connector described in JP-A-2020-031025, both side surfaces of a part (an opposite portion facing a spring portion having a contact portion with a mating terminal) of each terminal exposed inward from the resin of the housing are flat. Since there is no catch such as a protrusion suitable for support on the flat side surface, the mold, the fixing jig, or the like cannot sufficiently support the terminal so that there is no gap between the terminal and the mold, the fixed jig, or the like when supporting the terminal. Therefore, during insert molding, there is a possibility that the resin may flow from the gap between the terminal and the mold, the fixing jig, or the like, and cover a surface of the terminal that is originally exposed from the housing. The gap between the flat side surface of the terminal and the mold, the fixing jig, or the like is formed, for example, when distortion or the like occurs on the flat side surface of the terminal due to various factors such as manufacturing errors of the terminal. Also with respect to the fittings such as other metal members, the same problems as those related to the terminals as described above can occur.

In order to solve the above problems, the present disclosure provides the fitting suitable for forming the housing by insert molding. The fittings such as the terminals or the metal members held on a side wall of the housing of the plug connector or the receptacle connector of the present disclosure include a shoulder portion having an inclination configured to increase a width of a fixed portion on a side surface of the fixed portion held on the side wall of the housing. When the side surface of the fitting is supported by the mold, the fixing jig or the like, the shoulder portion in which the width of the fixed portion is increased is the protrusion suitable for the support by the mold, the fixing jig, or the like. Therefore, the part of the terminal and the fitting to be exposed from the housing can be sufficiently supported by the mold, the fixing jig, or the like without any gap.

A connector fitting according to the present disclosure includes: a fixed portion provided on a side wall of a housing of a connector; and a projecting portion provided on the side wall of the housing and projecting from the side wall of the housing with respect to the fixed portion, in which the fixed portion is wider than the projecting portion, the fixed portion includes a pair of shoulder portions on both side surfaces of the fixed portion, and the shoulder portions are provided on a side surface between the fixed portion and the projecting portion.

In the fittings such as the terminals or the metal members held on the side wall of the housing of the plug connector or the receptacle connector, by providing the shoulder portion having the inclination configured to increase the width of the fixed portion on the side surface of the fixed portion held on the side wall of the housing, since the shoulder portion having an increased width of the fixed portion serves as a protrusion suitable for the support by the mold, the fixing jig, or the like, when supporting the side surface of the fitting by the mold, the fixing jig, or the like, the fitting can be sufficiently supported without any gap. Therefore, it is possible to suppress the inflow of the resin which is an insulator to an unintended portion during insert molding.

Embodiments of the present disclosure will be described below with reference to the drawings. Note that in all the drawings for describing the embodiments, the same members are denoted by the same reference numerals in principle, and repeated descriptions thereof will be omitted. Further, configuration and shape of the plug connector or the receptacle connector according to the embodiments of the present disclosure are in a point-symmetrical relationship with a central axis in a fitting direction (Z-axis direction) as a point of symmetry. Therefore, it is basically omitted to give the same reference numerals to portions, members, components, and the like that are point-symmetrical with respect to the portions, members, components, and the like that are denoted by the reference numerals. Further, although each embodiment is described independently, it does not preclude combination of the components of each other to form the plug connector or the receptacle connector. Further, in the following description, the configuration including the plug connector and the receptacle connector may be referred to as a connector device.

In the present specification and claims, the connectors are referred to as the plug connector and the receptacle connector in order to distinguish between the two connectors. Each member, component, or the like of the plug connector and the receptacle connector is referred to as a plug housing and a receptacle housing, a plug terminal and a receptacle terminal, a first plug locking portion and a first receptacle locking portion, a second plug locking portion and a second receptacle locking portion, a plug fixing portion and a receptacle fixing portion, and the like. However, when the shapes of the connectors are not distinguished from each other, expressions of the plug and the receptacle may be omitted and simply referred to as a connector, a housing, a terminal, a first locking portion, a second locking portion, a fixed portion, or the like. Further, when the shapes of the connectors are not distinguished from each other, the first plug locking portion and the first receptacle locking portion may be referred to as a first projecting portion, and the second plug locking portion and the second receptacle locking portion are referred to as a second projecting portion. Furthermore, the first locking portion and the second locking portion may be simply referred to as a projecting portion.

Further, when the shapes of the connectors are not distinguished from each other, the other connector that fits with one connector may be referred to as a mating connector, and the first locking portion and the second locking portion of the mating connector may be referred to as a first mating locking portion and a second mating locking portion. Further, the metal members such as the plug terminal, the receptacle terminal, a plug additional member, and a receptacle additional member may be simply referred to as the fittings.

Figure 2:
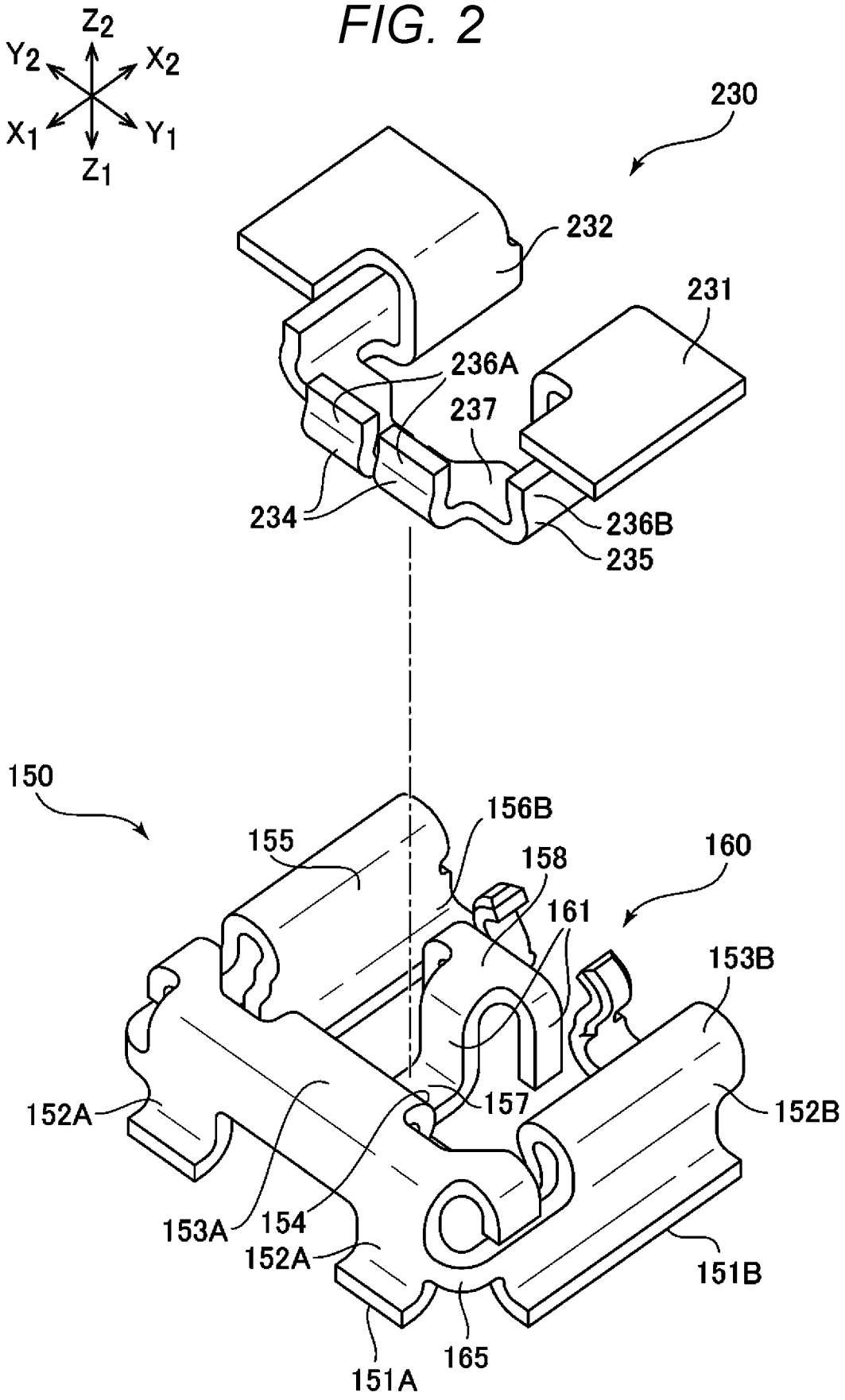
FIG. 2 is a perspective view of a plug additional member and a receptacle additional member respectively included in the plug connector and the receptacle connector illustrated in FIG. 1.
Figure 3:
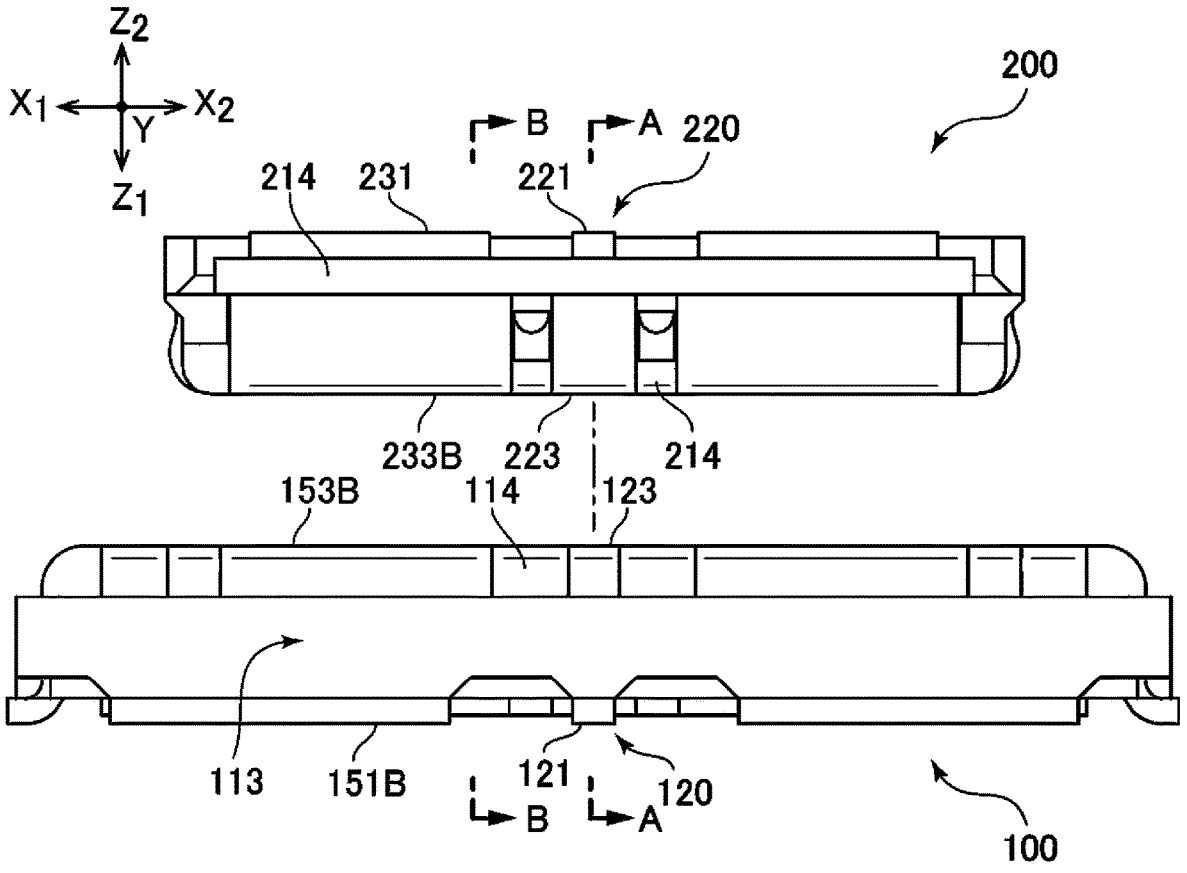
FIG. 3 is a side view of the plug connector and the receptacle connector according to the embodiment of the present disclosure.
Figure 4:
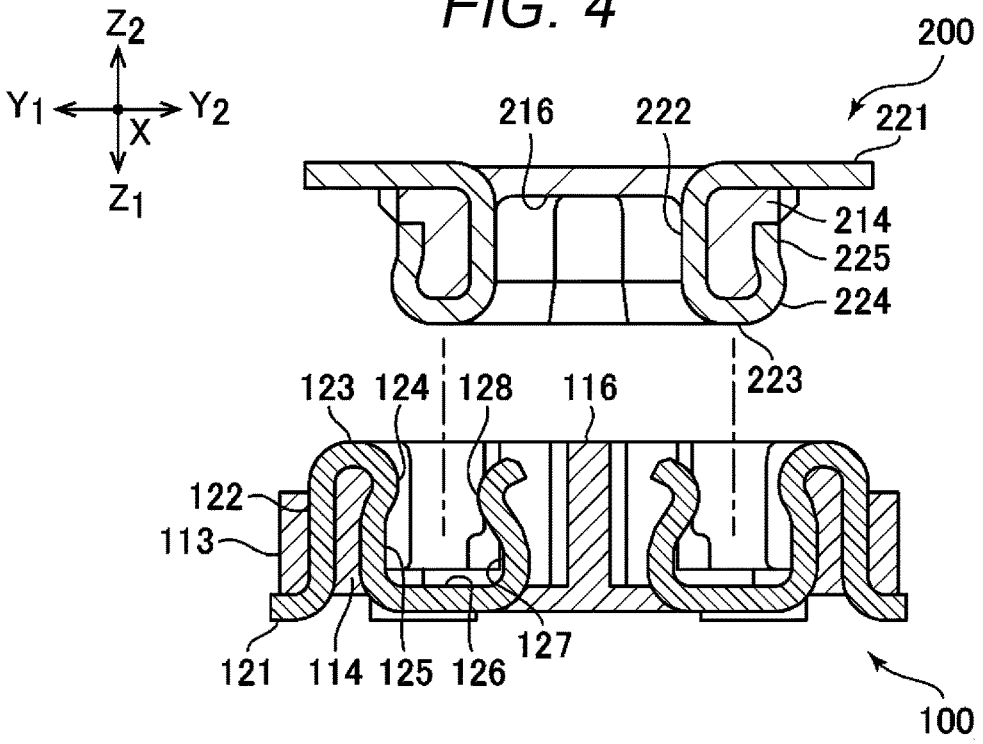
FIG. 4 is a cross-sectional view of a plug terminal and a receptacle terminal taken along a line A-A illustrated in FIG. 3.
Figure 5:
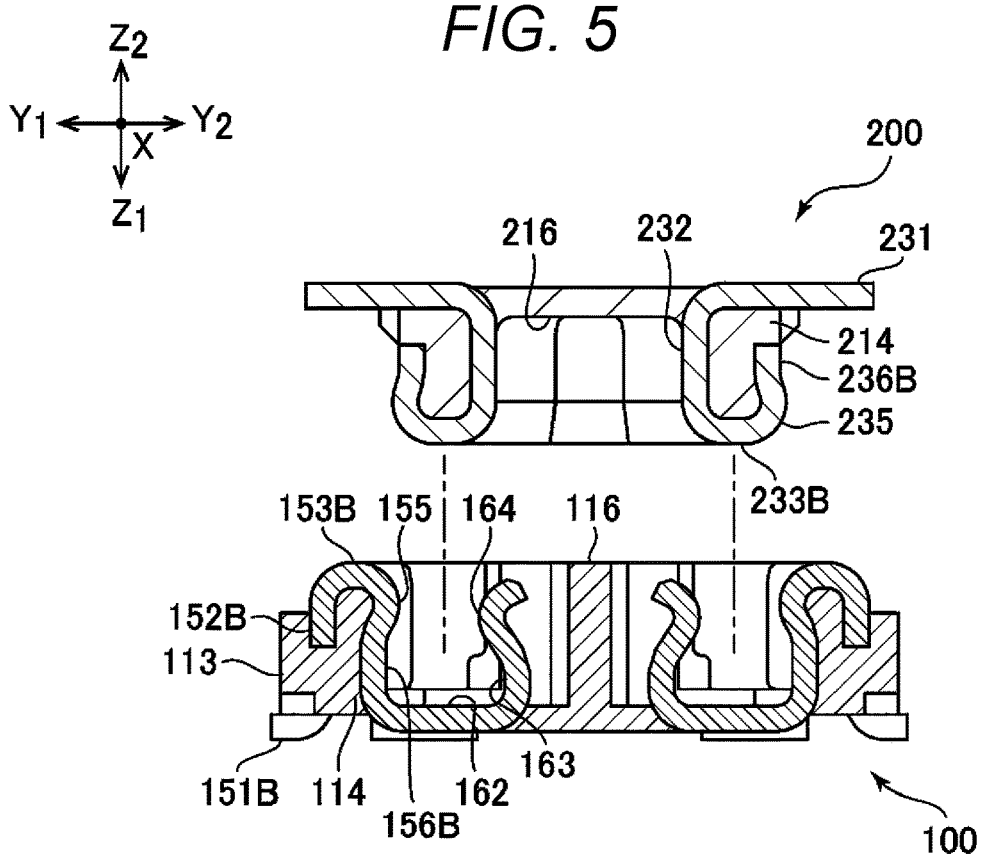
FIG. 5 is a cross-sectional view of a power supply terminal and a portion where the power supply terminal contacts, taken along a line B-B illustrated in FIG. 3.
Figure 6:
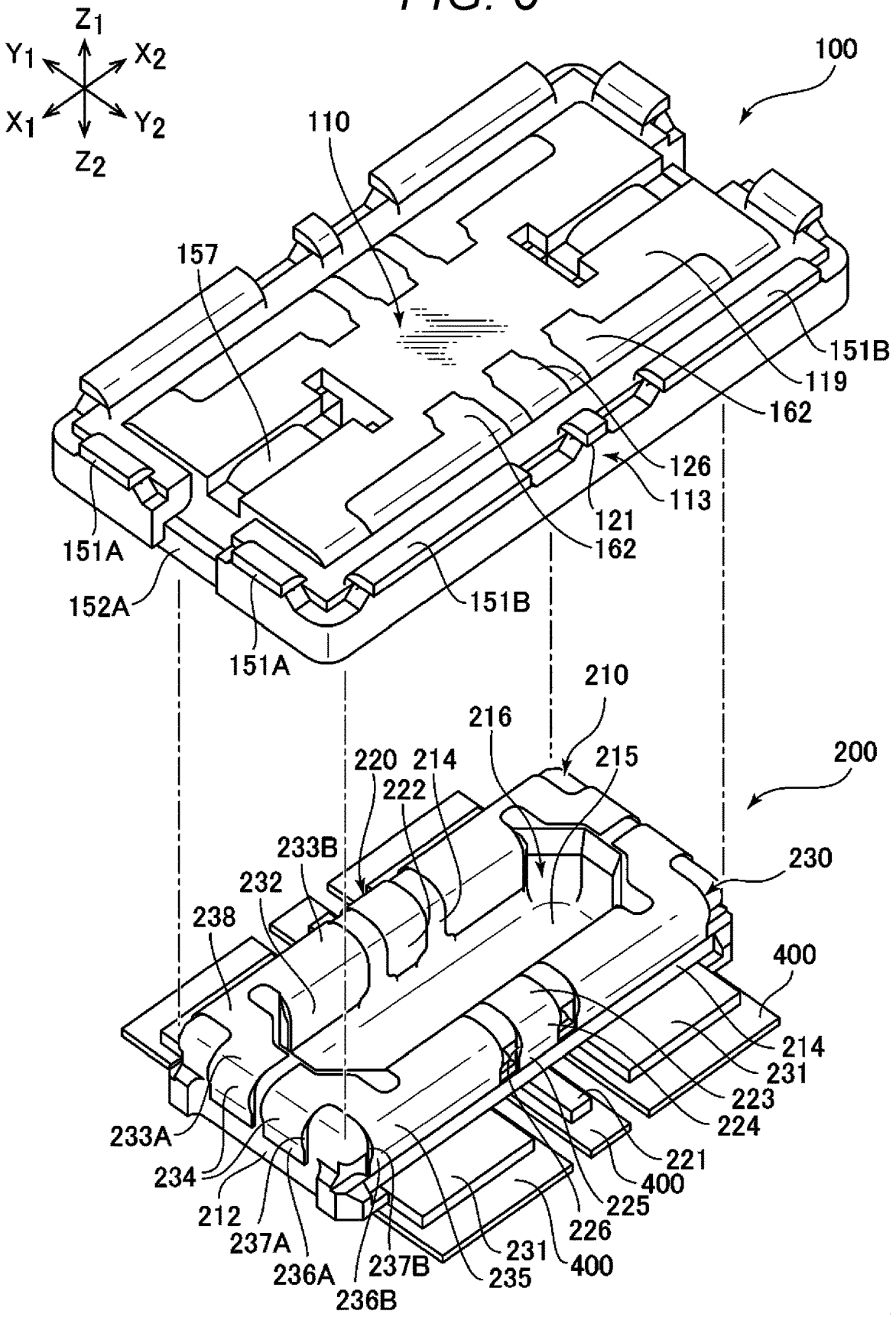
FIG. 6 is a perspective view of the plug connector and the receptacle connector according to the embodiment of the present disclosure as viewed from the receptacle connector side.

FIGS. 1 to 7 illustrate the plug connector and the receptacle connector according to an embodiment of the present disclosure. FIG. 1 is a perspective view of an appearance of the plug connector and the receptacle connector according to the embodiment of the present disclosure as viewed from the plug connector side (Z2 side). FIG. 2 is a perspective view of the plug additional member and the receptacle additional member respectively included in the plug connector and the receptacle connector illustrated in FIG. 1. FIG. 3 is a side view of the plug connector and the receptacle connector according to the embodiment of the present disclosure as viewed from the side surface (Y1 side). FIG. 4 is a cross-sectional view of the plug terminal and the receptacle terminal taken along a line A-A illustrated in FIG. 3. FIG. 5 is a cross-sectional view of a power supply terminal and a portion where the power supply terminal contacts, taken along a line B-B illustrated in FIG. 3. FIG. 6 is an upside-down view of FIG. 1, and is a perspective view of the appearance of the plug connector and the receptacle connector as viewed from the receptacle connector side (Z1 side).

Figure 7:
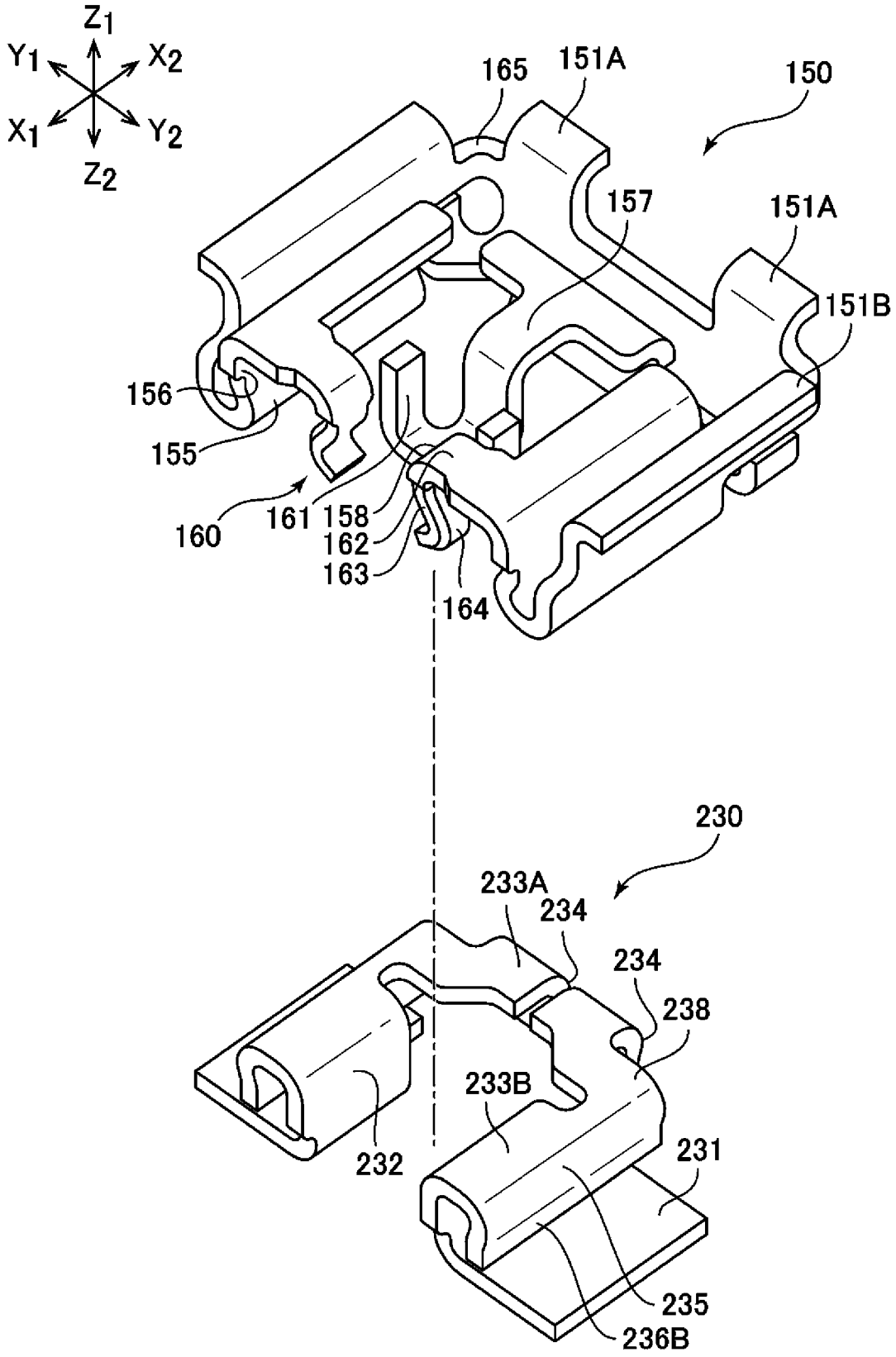
FIG. 7 is a view illustrating only the plug additional member and the receptacle additional member respectively included in the plug connector and the receptacle connector illustrated in FIG. 6.

FIG. 7 is a perspective view of the plug additional member and the receptacle additional member respectively included in the plug connector and the receptacle connector illustrated in FIG. 6.

The plug connector and the receptacle connector of the present disclosure can be used as an internal component in a small electronic device such as a mobile phone, a smartphone, a digital camera, or a notebook computer. The fitting direction (Z-axis direction) of the connector is a Z1-Z2 direction in the drawing. A length in the fitting direction (Z-axis direction) in a connector fitting state is about 0.3 to 1 mm, and is about 0.5 mm in the connector device of the present embodiment. A plug connector 200 is fitted with a receptacle connector 100 which is the mating connector on the Z1 side in the Z-axis direction, and the receptacle connector 100 is fitted with the plug connector 200 which is the mating connector on the Z2 side in the Z-axis direction, so that they are electrically connected to each other. In the present disclosure, a longitudinal direction of the rectangular connector is an X1-X2 direction (X-axis direction), and a lateral direction perpendicular to the longitudinal direction (X-axis direction) is a Y1-Y2 direction (Y-axis direction).

Further, regarding upper and lower sides of the receptacle connector 100 and a receptacle terminal 120, a substrate side (a side attached to the substrate) is "down" or "back", and a side receiving the plug connector 200 and a plug terminal 220 is "up" or "front". Similarly, regarding the upper and lower sides of the plug connector 200 and the plug terminal 220, a substrate side (a side attached to the substrate) is "down" or "back", and a side receiving the receptacle connector 100 and the receptacle terminal 120 is "up" or "front".

The receptacle connector 100 and the plug connector 200 are mounted on a printed wiring board, a flexible flat cable, or the like by soldering. Here, the printed wiring board, the flexible flat cable, or the like on which the connector is mounted are simply referred to as the "substrate". As illustrated in FIG. 1, the receptacle connector 100 is mounted on a substrate 300. As illustrated in FIG. 6, the plug connector 200 is mounted on a substrate 400.

First, configuration of the receptacle connector 100 will be described mainly with reference to FIGS. 1 and 2. The receptacle connector 100 includes a receptacle housing 110, a receptacle terminal 120, and a receptacle additional member 150 for maintaining a fitted state with the plug connector 200 which is the mating connector. The receptacle terminal 120 is made of a metal such as phosphor bronze. The receptacle terminal 120 is held in the receptacle housing 110 by being embedded in a second side wall portion 114 extending in the longitudinal direction (X-axis direction) of the receptacle housing 110 in a state where a surface in contact with the plug terminal 220, which is the mating terminal, is exposed from the second side wall portion 114. The receptacle terminal 120 includes a mounting portion 121 at an end thereof for being mounted on the substrate 300 by soldering or the like.

The receptacle housing 110 is made of an insulating resin such as a liquid crystal polymer (LCP). The receptacle housing 110 includes a pair of first side wall portions 112 extending in the lateral direction (Y-axis direction) and a pair of second side wall portions 114 extending in the longitudinal direction (X-axis direction), and includes a fitting protrusion 116 extending in the longitudinal direction (X-axis direction) in a central portion surrounded by the first side wall portions 112 and the second side wall portions 114. That is, the receptacle housing 110 includes the fitting protrusion 116 on a movable portion 127 side of the receptacle terminal 120, and includes the second side wall portion 114 on a terminal fixing portion 125 side of the receptacle terminal 120. Further, the receptacle housing 110 includes a receiving portion 118 as a space for housing first side wall portions 212 and second side wall portions 214 (see FIG. 6) of the plug connector 200 between the fitting protrusion 116 and the first side wall portion 112, and the second side wall portion 114. The substrate side (Z1 side) of the receiving portion 118 is closed by a bottom wall 119. That is, the receiving portion 118 is formed as a space defined by the first side wall portions 112, the second side wall portions 114, and the bottom wall 119, and open toward a fitting side (Z2 side) with the mating connector, and the fitting protrusion 116 is disposed inside the receiving portion 118.

When the receptacle connector 100 and the plug connector 200 are connected, the fitting protrusion 116 of the receptacle connector 100 is housed in a fitting recess 216 (see FIG. 6) of the plug connector 200, and the first side wall portions 212 and the second side wall portions 214 (see FIG. 6) of the plug connector 200 are housed in the receiving portion 118 of the receptacle connector 100.

Here, referring to FIG. 4 in addition to FIGS. 1 and 2, the receptacle terminal 120 includes a leg portion 122 via a portion bent upward (Z2 side in the Z-axis direction) from the mounting portion 121. The leg portion 122 faces a fixed contact 124 and the terminal fixing portion 125 with the second side wall portion 114 of the receptacle housing 110 interposed therebetween. The leg portion 122 and the fixed contact 124, and the terminal fixing portion 125 are connected via a top portion 123 located at an upper end of the second side wall portion 114.

Periphery of the leg portion 122 is entirely covered with the resin of the receptacle housing 110 (resin of a peripheral wall portion 113 and the second side wall portion 114) except for a portion adjacent to the top portion 123. That is, the leg portion 122 is held in the receptacle housing 110 by being embedded in the second side wall portion 114 by the peripheral wall portion 113 surrounding the first side wall portions 112 and the second side wall portions 114 except for the portion adjacent to the top portion 123. Back surfaces (surfaces opposite to surfaces in contact with the mating terminal) of the leg portion 122, the top portion 123, the fixed contact 124, and the terminal fixing portion 125 are supported by the second side wall portion 114. That is, in the leg portion 122 and the terminal fixing portion 125 of the receptacle terminal 120, the surfaces facing each other of the leg portion 122 and the terminal fixing portion 125 are supported by the second side wall portion 114.

The fixed contact 124 of the receptacle terminal 120 projects toward the fitting protrusion 116 from a surface of the second side wall portion 114, and a contact side surface 129 of the fixed contact 124 is exposed from the second side wall portion 114. The fixed contact 124 is electrically connected to an outer leg portion 225 by coming into contact with the outer leg portion 225 in a fitted state with the plug terminal 220 which is the mating terminal (see FIG. 4). The surfaces of the fixed contact 124 and the terminal fixing portion 125 opposite to the surfaces in contact with the mating terminal are supported and fixed by the second side wall portion 114 so as not to move when fitting with the mating terminal.

As is apparent from the cross-sectional view illustrated in FIG. 4, the receptacle terminal 120 is formed by insert molding (integral molding) with the receptacle housing 110, and is in close contact with the receptacle housing 110 except for a portion on the movable portion 127 side. Further, a space surrounded by the leg portion 122, the top portion 123, the fixed contact 124, and the terminal fixing portion 125 of the receptacle terminal 120 is filled with the resin (housing).

The receptacle terminal 120 includes a bottom portion 126 connected to the terminal fixing portion 125 and the movable portion 127, between the terminal fixing portion 125 and the movable portion 127. The bottom portion 126 extends in the lateral direction (Y-axis direction) of the receptacle connector 100 and is connected to the terminal fixing portion 125 and the movable portion 127 via portions bent at a right angle. A plate thickness direction of the bottom portion 126 is in the fitting direction (Z-axis direction). A surface of the bottom portion 126 on the receiving portion 118 side (a Z2 side surface) is exposed from the bottom wall 119 of the receptacle housing 110. A part of a surface (that is, a back surface) of the bottom portion 126 on the substrate side (the opposite side (Z1 side) to a surface (the Z2 side surface) receiving the mating terminal) is exposed from a back surface of the bottom wall 119 of the receptacle housing 110, and a portion other than the exposed portion is supported by the resin near the second side wall portion 114 and the fitting protrusion 116 (see FIG. 6). Therefore, the movable portion 127 is not visible from the back surface side of the bottom wall 119.

The movable portion 127 is not in contact with a side wall of the fitting protrusion 116, and an end of the movable portion 127 is a free end. The movable portion 127 includes a movable contact 128 formed by projecting periphery of the end toward the fixed contact 124. When the movable portion 127 receives and fits the plug terminal 220 which is the mating terminal, the movable portion 127 is elastically pushed and deformed toward the fitting protrusion 116. In the fitted state, the movable contact 128 contacts an inner leg portion 222 of the plug terminal 220, to be electrically connected to the inner leg portion 222.

The receptacle additional members 150 are arranged on both sides of the receptacle connector 100 while sandwiching a central portion of the second side wall portion 114 holding the receptacle terminal 120. That is, the receptacle additional members 150 are provided at both ends of the receptacle connector 100 in the longitudinal direction (X-axis direction). The receptacle additional member 150 includes a first receptacle locking portion 154 which is one projecting portion, and second receptacle locking portions 155 which are a pair of projecting portions. The receptacle housing 110 holds one first receptacle locking portion 154 by the first side wall portion 112 and a pair of second receptacle locking portions 155 by the second side wall portions 114. The receptacle additional member 150 includes the pair of second receptacle locking portions 155 extending in a direction (the X-axis direction) perpendicular to the first receptacle locking portion 154 on both sides (Y1 and Y2 sides) of the first receptacle locking portion 154 held by the first side wall portion 112. That is, the first receptacle locking portion 154 is located between the pair of second receptacle locking portions 155 in the lateral direction (Y-axis direction). A portion including the first receptacle locking portion 154 and a portion including the second receptacle locking portion 155 are connected via a receptacle connecting portion 165. The receptacle connecting portion 165 is embedded in the receptacle housing 110.

Figure 8:
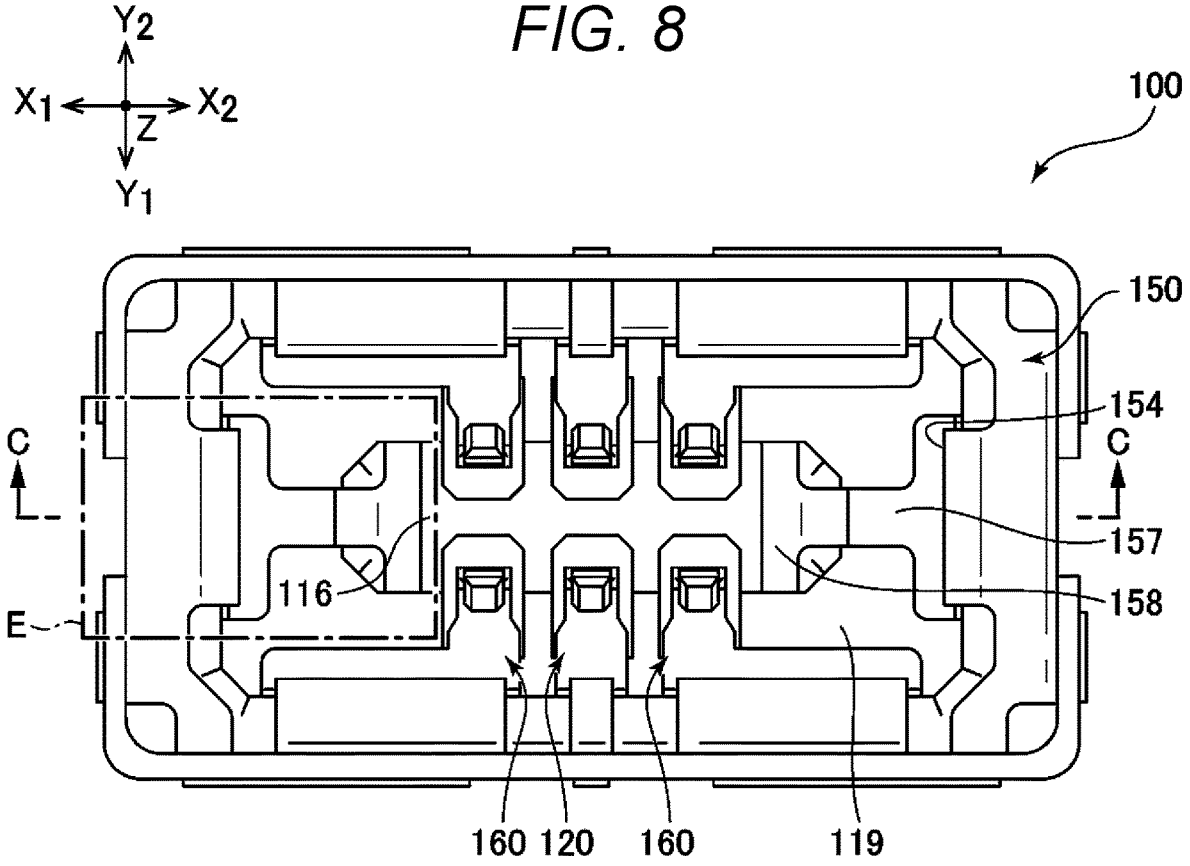
FIG. 8 is a top view of the receptacle connector according to the embodiment of the present disclosure.
Figure 9:
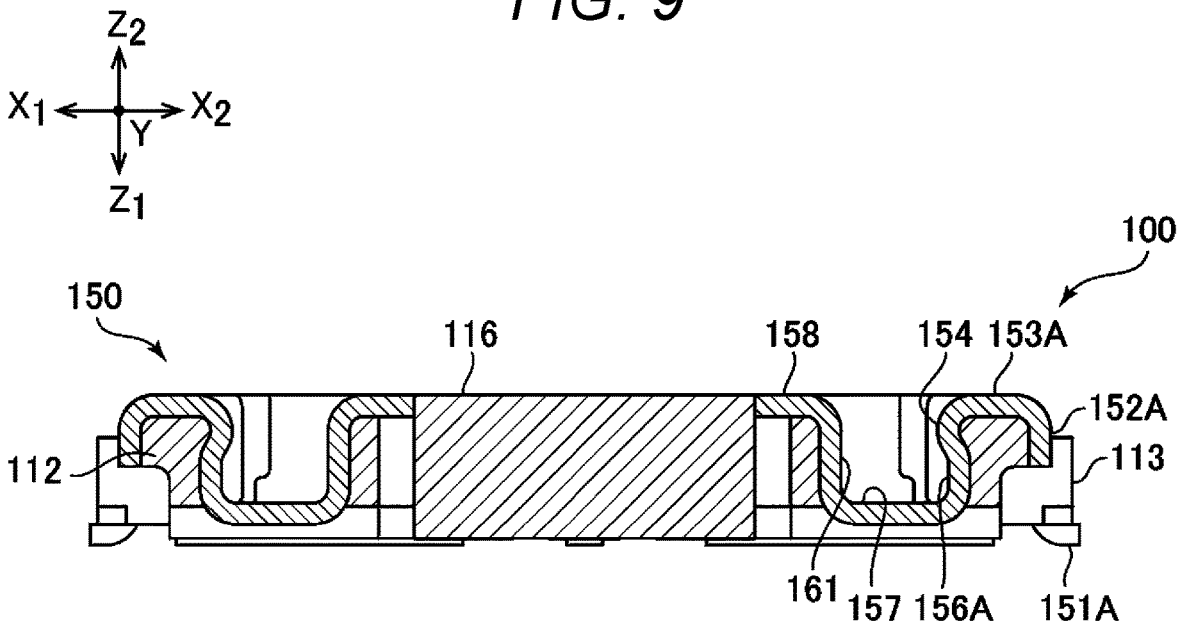
FIG. 9 is a cross-sectional view of the receptacle connector taken along a line C-C illustrated in FIG. 8.

Here, the configuration of the receptacle connector according to the embodiment of the present disclosure will be described with reference to FIGS. 8 and 9 in addition to FIGS. 1 and 2. FIG. 8 is a top view of the receptacle connector according to the embodiment of the present disclosure. FIG. 9 is a cross-sectional view of the receptacle connector taken along a line C-C illustrated in FIG. 8.

The receptacle additional member 150 includes mounting portions 151A and 151B for being mounted on the substrate 300 by soldering or the like. The receptacle additional member 150 includes receptacle leg portions 152A and 152B via a portion bent upward (Z2 side in the Z-axis direction) from the mounting portions 151A and 151B. The first receptacle locking portion 154 and the receptacle leg portion 152A face each other with the first side wall portion 112 interposed therebetween. The first receptacle locking portion 154 and the receptacle leg portion 152A are connected via a top portion 153A located at an end of the first side wall portion 112. Similarly, the second receptacle locking portion 155 and the receptacle leg portion 152B face each other with the second side wall portion 114 interposed therebetween. The second receptacle locking portion 155 and the receptacle leg portion 152B are connected via a top portion 153B located at an end of the second side wall portion 114.

The first receptacle locking portion 154 is connected to the mounting portion 151A via the receptacle leg portion 152A. By attaching the mounting portion 151A to the substrate 300 by soldering or the like, the receptacle additional member 150 can withstand a force applied when the connectors are connected to each other. Similarly, the second receptacle locking portion 155 is connected to the mounting portion 151B via the receptacle leg portion 152B. By attaching the mounting portion 151B to the substrate 300 by soldering or the like, the receptacle additional member 150 can withstand the force applied when the connectors are connected to each other.

Periphery of the receptacle leg portions 152A and 152B is entirely covered with the resin of the receptacle housing 110 except for a portion adjacent to the top portions 153A and 153B. That is, the receptacle leg portions 152A and 152B are held in the receptacle housing 110 by being embedded in the first side wall portion 112 and the second side wall portion 114 by the peripheral wall portion 113 surrounding the first side wall portion 112 and the second side wall portion 114 except for the portion adjacent to the top portions 153A and 153B. Back surfaces of the receptacle leg portion 152A, the top portion 153A, and the first receptacle locking portion 154 are supported by the first side wall portion 112. Back surfaces of the receptacle leg portion 152B, the top portion 153B, and the second receptacle locking portion 155 are supported by the second side wall portion 114.

The first receptacle locking portion 154 is configured to be a curved surface projecting from a surface of the first side wall portion 112. Alternatively, the first receptacle locking portion 154 is configured to include the curved surface projecting from the surface of the first side wall portion 112. The first receptacle locking portion 154 extends in the lateral direction (Y-axis direction). A cross-sectional shape of an extending portion of the first receptacle locking portion 154 in a direction perpendicular to the lateral direction (Y-axis direction) includes the same curved surface projecting from the surface of the first side wall portion 112. The second receptacle locking portion 155 is configured to be a curved surface projecting from the surface of the second side wall portion 114. Alternatively, the second receptacle locking portion 155 is configured to include the curved surface projecting from the surface of the second side wall portion 114. The second receptacle locking portion 155 extends in the longitudinal direction (X-axis direction). A cross-sectional shape of an extending portion of the second receptacle locking portion 155 in a direction perpendicular to the longitudinal direction (X-axis direction) includes the same curved surface projecting from the surface of the second side wall portion 114. The first receptacle locking portion 154 and the second receptacle locking portion 155 respectively include receptacle locking side surfaces 159A and 159B exposed from the first side wall portion 112 and the second side wall portion 114. The receptacle additional member 150 includes receptacle fixing portions 156A and 156B (a first receptacle fixing portion and a second receptacle fixing portion) located closer to the first side wall portion 112 and the second side wall portion 114 than positions where the first receptacle locking portion 154 and the second receptacle locking portion 155 are provided, on a bottom side (Z1 side) of the receptacle housing 110 from the positions where the first receptacle locking portion 154 and the second receptacle locking portion 155 are provided. Note that a shoulder portion 166 (see FIG. 20) described below is formed on the bottom wall 119 side (Z1 side) of the receptacle locking side surface 159A. The receptacle locking side surface 159A and the shoulder portion 166 are continuous surfaces. The receptacle locking side surface 159B also has the same configuration as the receptacle locking side surface 159A.

The receptacle additional member 150 includes a T-shaped portion 158 at a position facing the first receptacle locking portion 154. The T-shaped portion 158 is connected to the first receptacle locking portion 154 via a bottom portion 157 and the first receptacle fixing portion 156A. The T-shaped portion 158 is held by a fitting portion fixing piece 161 extending in the fitting direction (Z-axis direction) so as to cover a part of an end side wall in the longitudinal direction (X-axis direction) of the fitting protrusion 116. With such a configuration, the receptacle additional member 150 can be fixed to the receptacle housing 110. The bottom portion 157, the first receptacle fixing portion 156A, and the fitting portion fixing piece 161 face the receiving portion 118 in a state of being exposed from the receptacle housing 110. Further, the receptacle additional member 150 includes a plurality of power supply terminals 160 on a side adjacent to the receptacle terminal 120 (an X2 side of the receptacle additional member 150 located on an X1 side and the X1 side of the receptacle additional member 150 located on the X2 side). The power supply terminal 160 is a terminal for supplying electric power of about several amperes, and is a contact point for power supply with the plug connector 200. The power supply terminals 160 of the receptacle additional member 150 are arranged on the second side wall portion 114 at equal intervals on both sides (X1 side and X2 side) of the receptacle terminal 120 in a state of being lined up with the receptacle terminal 120.

Here, referring to FIG. 5 in addition to FIGS. 1 and 2, the receptacle leg portion 152B of the receptacle additional member 150 faces the second receptacle locking portion 155 and the second receptacle fixing portion 156B with the second side wall portion 114 of the receptacle housing 110 interposed therebetween. The receptacle leg portion 152B and the second receptacle locking portion 155, and the second receptacle fixing portion 156B are connected via the top portion 153B located at the upper end of the second side wall portion 114.

The periphery of the receptacle leg portion 152B is entirely covered with the resin of the receptacle housing 110 (resin of the peripheral wall portion 113 and the second side wall portion 114) except for the portion adjacent to the top portion 153B. That is, the receptacle leg portion 152B is held by the receptacle housing 110 by being embedded in the second side wall portion 114 by the peripheral wall portion 113 surrounding the first side wall portion 112 and the second side wall portion 114 except for the portion adjacent to the top portion 153B. Back surfaces (surfaces opposite to surfaces in contact with a second plug locking portion 235) of the receptacle leg portion 152B, the top portion 153B, the second receptacle locking portion 155, and the second receptacle fixing portion 156B are supported by the second side wall portion 114. That is, in the receptacle leg portion 152B and the second receptacle fixing portion 156B on the second receptacle locking portion 155 side of the receptacle additional member 150, the surfaces facing each other of the receptacle leg portion 152B and the second receptacle fixing portion 156B are supported by the second side wall portion 114.

The power supply terminal 160 extends from the second receptacle fixing portion 156B toward the fitting protrusion 116, and includes a bottom portion 162 connected to the second receptacle fixing portion 156B and a movable portion 163, between the second receptacle fixing portion 156B and the movable portion 163. The bottom portion 162 extends in the lateral direction (Y-axis direction) of the receptacle connector 100 and is connected to the second receptacle fixing portion 156B and the movable portion 163 via portions bent at a right angle. A part of a surface (that is, a back surface) of the bottom portion 162 on the substrate side (the opposite side (Z1 side) to a surface (the Z2 side surface) receiving the mating terminal) is exposed from a back surface of the receptacle housing 110, and a portion other than the exposed portion is supported by the resin near the second side wall portion 114 and the fitting protrusion 116 (see FIGS. 5 and 6).

As is apparent from the cross-sectional view illustrated in FIG. 5, the receptacle additional member 150 is formed by insert molding (integral molding) with the receptacle housing 110, and is in close contact with the receptacle housing 110 except for a portion on the movable portion 163 side of the power supply terminal 160. Further, a space surrounded by the receptacle leg portion 152B, the top portion 153B, the second receptacle locking portion 155, and the second receptacle fixing portion 156B of the receptacle additional member 150 is filled with the resin (housing).

The movable portion 163 is not in contact with the side wall of the fitting protrusion 116, and an end of the movable portion 163 is a free end. The movable portion 163 includes a movable contact 164 formed by projecting periphery of the movable portion 163 toward the second receptacle locking portion 155. When the movable portion 163 receives and fits a plug additional member 230 which is a mating additional member, the movable portion 163 is elastically pushed and deformed toward the fitting protrusion 116. In the fitted state, the movable contact 164 contacts a plug fixing portion 232 of the plug additional member 230, to be electrically connected to the plug fixing portion 232.

Next, configuration of the plug connector 200 will be described mainly with reference to FIGS. 6 and 7. The plug connector 200 includes a plug housing 210, the plug terminal 220, and the plug additional member 230 for maintaining a fitted state with the receptacle connector 100 which is the mating connector. The plug terminal 220 is made of a metal such as phosphor bronze. The plug terminal 220 is held in the plug housing 210 by being embedded in the second side wall portion 214 extending in the longitudinal direction (X-axis direction) of the plug housing 210 in a state where a surface in contact with the receptacle terminal 120, which is the mating terminal, is exposed from the second side wall portion 214. The plug terminal 220 includes a mounting portion 221 at an end thereof for being mounted on the substrate 400 by soldering or the like.

The plug housing 210 is made of the insulating resin such as a liquid crystal polymer (LCP). The plug housing 210 includes the first side wall portion 212 extending in the lateral direction (Y-axis direction) and the second side wall portion 214 extending in the longitudinal direction (X-axis direction), and includes the fitting recess 216 as a space for housing the fitting protrusion 116, in a central portion surrounded by the first side wall portion 212 and the second side wall portion 214.

When the plug connector 200 and the receptacle connector 100 are connected, the fitting recess 216 of the plug connector 200 functions as a receiving portion for housing the fitting protrusion 116 of the receptacle connector 100, and the first side wall portion 212 and the second side wall portion 214 of the plug connector 200 are housed in the receiving portion 118 of the receptacle connector 100.

Here, referring to FIG. 4 in addition to FIGS. 6 and 7, the plug terminal 220 includes the mounting portion 221 at the end on the substrate side (Z2 side), and includes the inner leg portion 222 via a portion bent upward (Z1 side) at a right angle from the mounting portion 221. The inner leg portion 222 faces the outer leg portion 225 with the second side wall portion 214 of the plug housing 210 interposed therebetween. The inner leg portion 222 and the outer leg portion 225 are connected via a top portion 223 located at an end of the second side wall portion 214. Back surfaces (surfaces opposite to surfaces in contact with the mating terminal) of the inner leg portion 222, the top portion 223, a projecting portion 224, and the outer leg portion 225 are supported by the second side wall portion 214.

The projecting portion 224 is formed by projecting a portion of the outer leg portion 225 adjacent to the top portion 223 to the outside. A contact side surface 226 of the projecting portion 224 is exposed from the second side wall portion 214. In a fitted state with the receptacle terminal 120 which is the mating terminal, the projecting portion 224 can engage with the second receptacle locking portion 155 and maintain the fitted state (locked state). The inner leg portion 222, the top portion 223, the projecting portion 224, and the outer leg portion 225 are fixed by the second side wall portion 214 so as not to move during fitting with the mating terminal.

As is apparent from the cross-sectional view illustrated in FIG. 4, the plug terminal 220 is formed by insert molding (integral molding) with the plug housing 210, and is in close contact with the plug housing 210. Further, a space surrounded by the inner leg portion 222, the top portion 223, the projecting portion 224, and the outer leg portion 225 of the plug terminal 220 is filled with the resin (housing).

The plug additional members 230 are arranged on both sides of the plug connector 200 while sandwiching a central portion of the second side wall portion 214 holding the plug terminal 220. That is, the plug additional members 230 are provided at both ends of the plug connector 200 in the longitudinal direction (X-axis direction). The plug additional member 230 includes first plug locking portions 234 which are two projecting portions, and the second plug locking portions 235 which are a pair of projecting portions. The plug housing 210 holds two first plug locking portions 234 by the first side wall portion 212 and a pair of second plug locking portions 235 by the second side wall portions 214. The plug additional member 230 includes the pair of second plug locking portions 235 extending in a direction (the X-axis direction) perpendicular to the first plug locking portion 234 on both sides (Y1 and Y2 sides) of the two first plug locking portions 234 held by the first side wall portion 212. That is, the two first plug locking portions 234 are located between the pair of second plug locking portions 235 in the lateral direction (Y-axis direction). A portion including the first plug locking portion 234 and a portion including the second plug locking portion 235 are connected via a plug connecting portion 238. The plug connecting portion 238 is exposed from the plug housing 210.

Referring to FIG. 5, the plug additional member 230 includes a mounting portion 231 for being mounted on the substrate 400 by soldering or the like. The plug additional member 230 includes the plug fixing portion 232 via a portion bent upward (Z1 side in the Z-axis direction) from the mounting portion 231. The second plug locking portion 235 and the plug fixing portion 232 face each other with the second side wall portion 214 interposed therebetween. The second plug locking portion 235 and the plug fixing portion 232 are connected via a top portion 233B located at the end of the second side wall portion 214.

As is apparent from the cross-sectional view illustrated in FIG. 5, the plug additional member 230 is formed by insert molding (integral molding) with the plug housing 210, and is in close contact with the plug housing 210. Further, a space surrounded by the plug fixing portion 232, the top portion 233B, the second plug locking portion 235, and a plug flat surface portion 236B of the plug additional member 230 is filled with the resin (housing).

The plug fixing portion 232 is exposed from the second side wall portion 214. The plug fixing portion 232 is held by the plug housing 210 by covering a portion between the plug fixing portion 232 and the mounting portion 231 with the resin of the plug housing 210. Back surfaces of the first plug locking portion 234 and a top portion 233A are supported by the first side wall portion 212. Back surfaces of the second plug locking portion 235, the top portion 233A, and the plug fixing portion 232 are supported by the second side wall portion 214.

Figure 10:
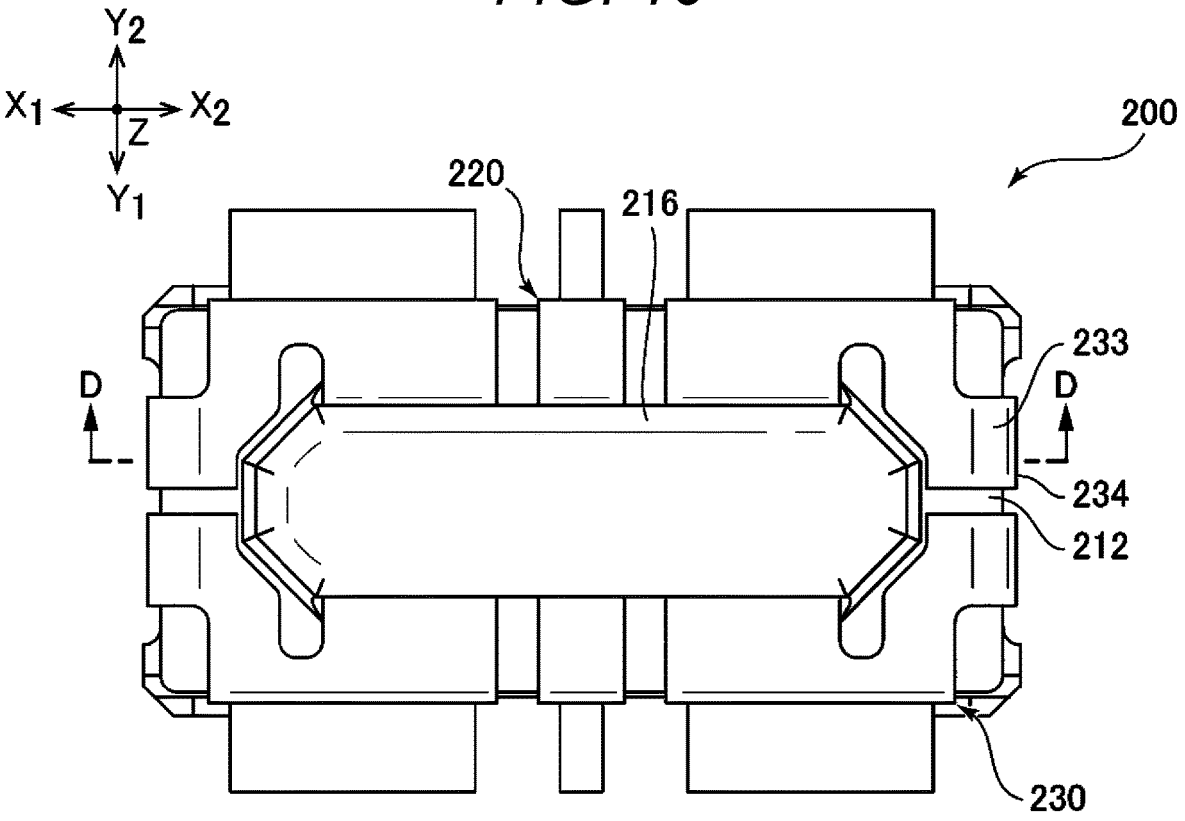
FIG. 10 is a top view of the plug connector according to the embodiment of the present disclosure.
Figure 11:
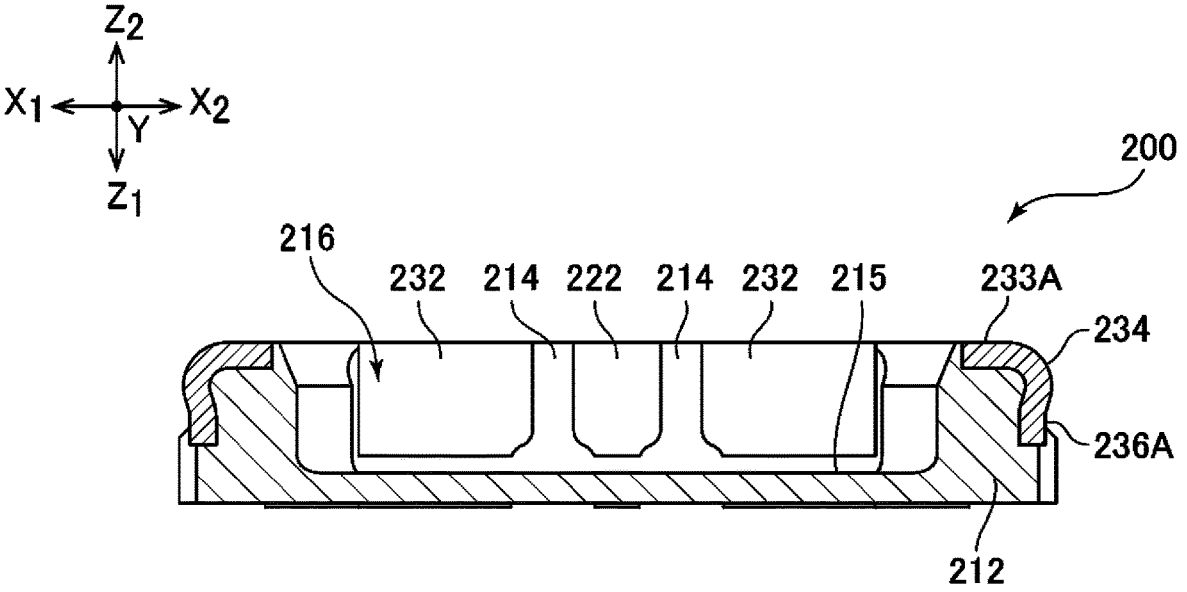
FIG. 11 is a cross-sectional view of the plug connector taken along a line D-D illustrated in FIG. 10.

Here, the configuration of the plug connector according to the embodiment of the present disclosure will be described with reference to FIGS. 10 and 11 in addition to FIGS. 6 and 7. FIG. 10 is a top view of the plug connector according to the embodiment of the present disclosure. FIG. 11 is a cross-sectional view of the plug connector taken along a line D-D illustrated in FIG. 10. The plug fixing portions 232 of the plug additional member 230 are arranged on both sides (X1 side and X2 side) of the plug terminal 220 at equal intervals from the plug terminal 220, and are held by the second side wall portion 214.

The first plug locking portion 234 is configured to be a curved surface projecting from a surface of the first side wall portion 212. Alternatively, the first plug locking portion 234 is configured to include the curved surface projecting from the surface of the first side wall portion 212. The first plug locking portion 234 extends in the lateral direction (Y-axis direction). A cross-sectional shape of an extending portion of the first plug locking portion 234 in a direction perpendicular to the lateral direction (Y-axis direction) includes the same curved surface projecting from the surface of the first side wall portion 212. The second plug locking portion 235 is configured to be a curved surface projecting from a surface of the second side wall portion 214. Alternatively, the second plug locking portion 235 is configured to include the curved surface projecting from the surface of the second side wall portion 214. The second plug locking portion 235 extends in the longitudinal direction (X-axis direction). A cross-sectional shape in a direction perpendicular to the longitudinal direction (X-axis direction) of a portion extending in the longitudinal direction (X-axis direction) of the second plug locking portion 235 includes the same curved surface projecting from the surface of the second side wall portion 214. The first plug locking portion 234 and the second plug locking portion 235 respectively include plug lock side surfaces 237A and 237B exposed from the first side wall portion 212 and the second side wall portion 214. The plug additional member 230 includes plug flat surface portions 236A and 236B, on the bottom side (Z1 side) of the plug housing 210 from positions where the first plug locking portion 234 and the second plug locking portion 235 are provided.

The first plug locking portion 234 is divided in a direction (X-axis direction) perpendicular to the first side wall portion 212 extending in the lateral direction (Y-axis direction). At ends of the divided first plug locking portion 234 and the plug flat surface portion 236A, the mounting portion for being mounted on the substrate 400 by soldering or the like is not provided. That is, the ends of the divided first plug locking portion 234 and the plug flat surface portion 236A are free ends. On the other hand, the first receptacle fixing portion 156A and the second receptacle fixing portion 156B respective of the first receptacle locking portion 154 and the second receptacle locking portion 155 of the receptacle additional member 150 are fixed to the substrate 300 by the mounting portions 151A and 151B.

By firmly fixing the first receptacle locking portion 154 and the second receptacle locking portion 155 to the substrate 300 in this way, the receptacle additional member 150 serves as a reference, and an amount of interference with the plug additional member 230, or the like is adjusted, so that it is possible to finely adjust a force (here, referred to as a locking force) applied when connecting the plug connector 200 and the receptacle connector 100 and while the plug connector 200 and the receptacle connector 100 are connected. That is, by configuring the first plug locking portion 234 divided into two and the plug flat surface portion 236A so as not to be fixed to the substrate 400, when the connectors are fitted to each other, the first plug locking portion 234 divided into two and the first side wall portion 212 holding the first plug locking portion 234 can be easily deformed. Therefore, the locking force is adjusted by releasing the force applied to the first plug locking portion 234 by deformation of the first plug locking portion 234 divided into two and the first side wall portion 212 holding the first plug locking portion 234.

Further, by configuring the first receptacle locking portion 154 and the second receptacle locking portion 155 of the receptacle additional member 150, and the first plug locking portion 234 and the second plug locking portion 235 of the plug additional member 230 so as to respectively include curved surfaces projecting from surfaces of the first side wall portions 112 and 212 and surfaces of the second side wall portions 114 and 214, it is possible to reduce manufacturing cost by omitting a step of processing the metal members (receptacle additional member 150 and plug additional member 230) to provide the protrusion and the recess, in a manufacturing process. Further, by configuring the first receptacle locking portion 154 and the second receptacle locking portion 155 of the receptacle additional member 150 and the first plug locking portion 234 and the second plug locking portion 235 of the plug additional member 230 so as to respectively include curved surfaces supported by the side wall portions, a force applied when the connectors are attached and detached is suppressed from being concentrated at one point, so that they have a structure resistant to deformation and wear.

Note that the configuration in which the first plug locking portion 234 of the plug additional member 230 is divided into two can also be applied to the first receptacle locking portion 154 of the receptacle additional member 150. It can also be configured such that the first receptacle locking portion 154 of the receptacle additional member 150 is divided into two, and an end of the receptacle leg portion 152A connected to the first receptacle locking portion 154 via the top portion 153A is not fixed to the substrate 300.

Figure 12:
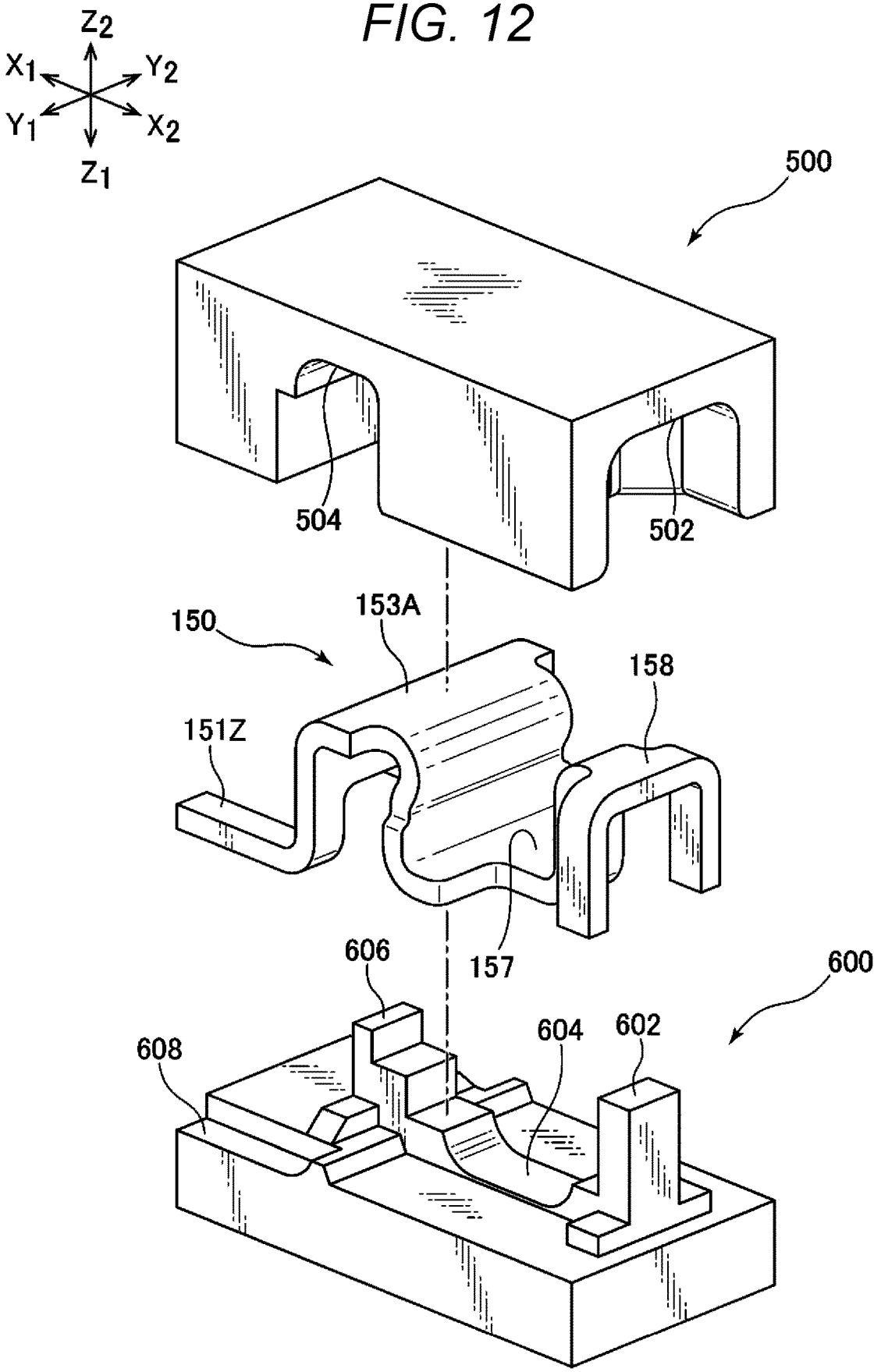
FIG. 12 is an external view of a part of the additional member included in the receptacle connector surrounded by a dotted line E illustrated in FIG. 8 and a mold for forming a housing by insert molding on the part of the additional member.
Figure 13:
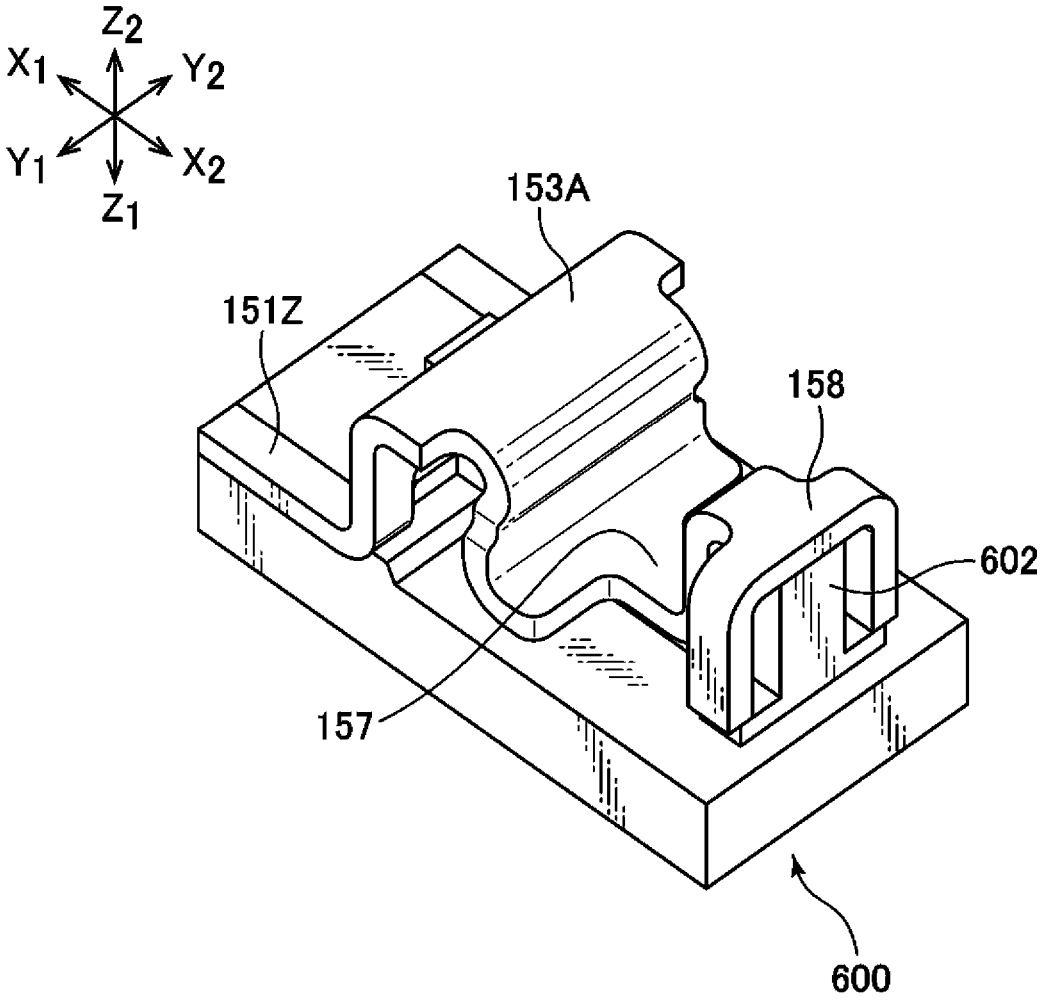
FIG. 13 is an external view illustrating a state in which a part of the additional member is placed on a lower mold illustrated in FIG. 12.

FIG. 12 is an external view of a part of an additional member included in the receptacle connector surrounded by a dotted line E illustrated in FIG. 8 and a mold for forming the housing by insert molding on the part of the additional member. The mold includes a lower mold 600 for mounting the receptacle additional member 150 and an upper mold 500 for covering the receptacle additional member 150 mounted on the lower mold 600. FIG. 13 is an external view illustrating a state in which the receptacle additional member 150 is placed on the lower mold 600.

Referring to FIG. 13 in addition to FIG. 12, the lower mold 600 includes a T-shaped portion support column 602, a bottom support surface 604, a receptacle leg portion support column 606 formed in a staircase pattern, and a connecting portion support surface 608 sequentially from the X2 side to the X1 side in the X-axis direction. When the receptacle additional member 150 is placed on the lower mold 600, the T-shaped portion support column 602 can support the T-shaped portion 158 of the receptacle additional member 150, the bottom support surface 604 can support the bottom portion 157 of the receptacle additional member 150, the receptacle leg portion support column 606 can support the receptacle leg portion 152A of the receptacle additional member 150. Further, in the receptacle additional member 150 before insert molding, a connecting portion 151Z with a carrier (not illustrated) extends in the X-axis direction from the mounting portion 151A. The connecting portion support surface 608 supports the connecting portion 151Z of the receptacle additional member 150.

Figure 14:
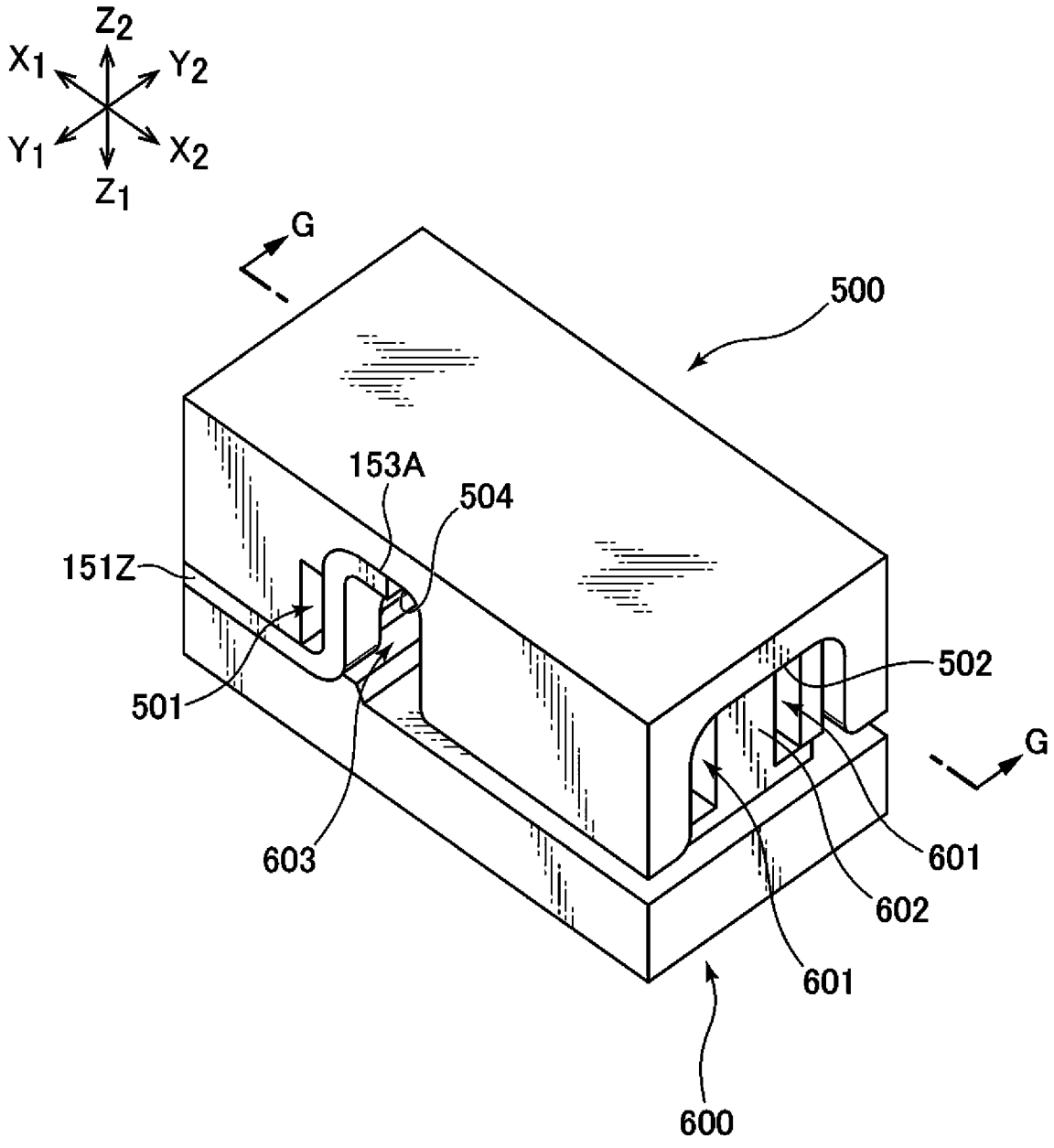
FIG. 14 is a perspective view illustrating a state in which the additional member placed on the lower mold illustrated in FIG. 13 is covered with an upper mold.
Figure 15:
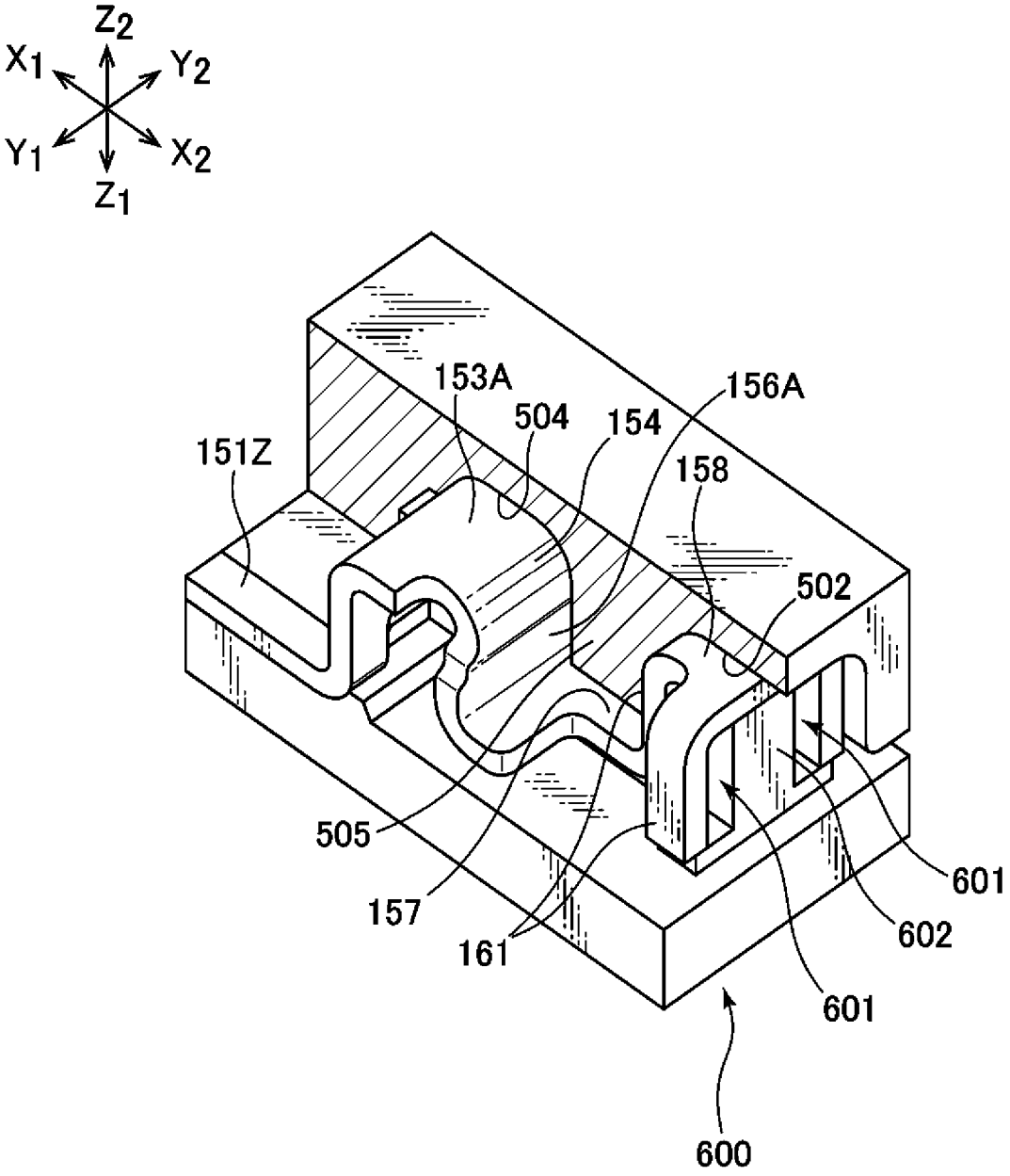
FIG. 15 is a perspective view of a cross-section of the upper mold taken along a line G-G illustrated in FIG. 14.
Figure 16:
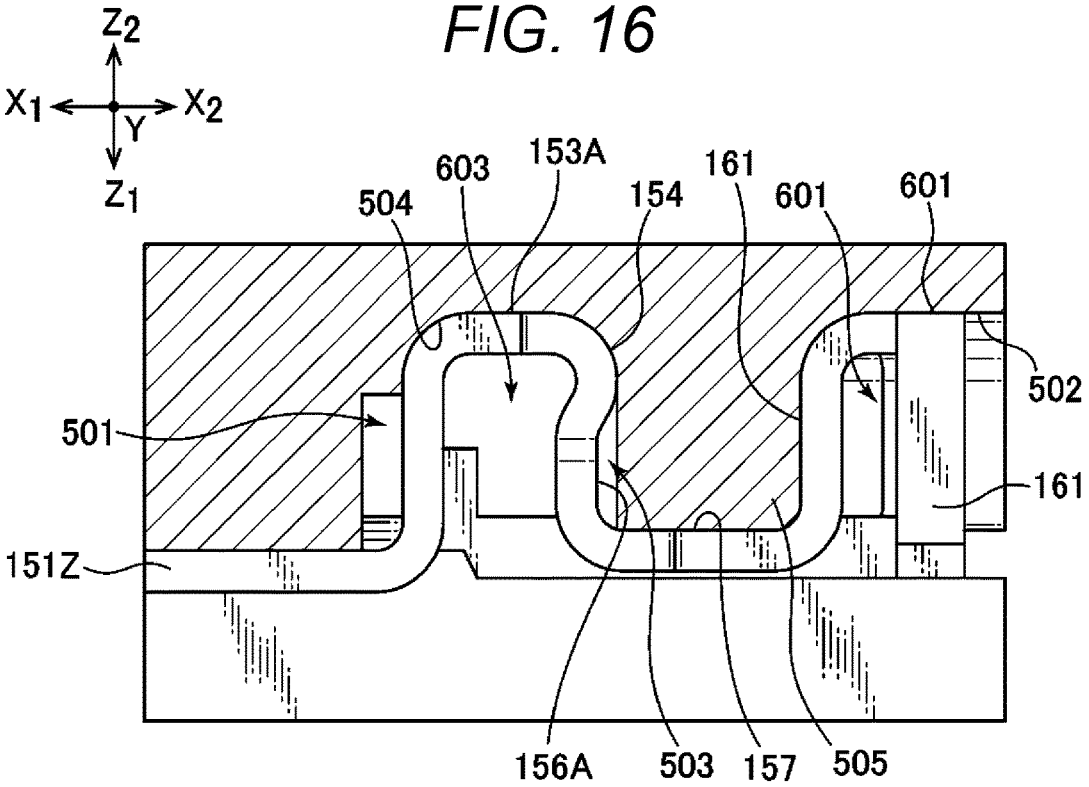
FIG. 16 is a side view of the cross-section of the upper mold taken along the line G-G illustrated in FIG. 14.

FIG. 14 is a perspective view illustrating a state in which the receptacle additional member 150 placed on the lower mold 600 is covered with the upper mold 500. FIG. 15 is a perspective view of a cross-section of the upper mold 500 taken along a line G-G illustrated in FIG. 14. FIG. 16 is a side view of the cross-section of the upper mold taken along the line G-G illustrated in FIG. 14. Referring to FIGS. 15 and 16 in addition to FIG. 14, the upper mold 500 includes a T-shaped portion contact surface 502 formed in a concave shape and a top portion contact surface 504 formed in a concave shape sequentially from the X2 side to the X1 side in the X-axis direction. The upper mold 500 includes a bottom portion fixing wall 505 that separates the T-shaped portion contact surface 502 and the top portion contact surface 504. The T-shaped portion contact surface 502 is in close contact with surfaces of the T-shaped portion 158 of the receptacle additional member 150 and the fitting portion fixing piece 161. The top portion contact surface 504 is in close contact with surfaces of the first receptacle locking portion 154 which is the projecting portion of the receptacle additional member 150, and the top portion 153A. The bottom portion fixing wall 505 is in close contact with surfaces of the bottom portion 157 of the receptacle additional member 150 and the fitting portion fixing piece 161.

There is a first resin filling space 601 between the T-shaped portion 158 and the T-shaped portion support column 602, and the fitting portion fixing piece 161. There is a second resin filling space 603 on a back side of the first receptacle locking portion 154 and the top portion 153A of the receptacle additional member 150. During insert molding, the insulating resin such as a liquid crystal polymer (LCP) flows into the first resin filling space 601 and the second resin filling space 603, and the resin flowed therein is cured to form the fitting protrusion 116 and the first side wall portion 112.

Figure 17:
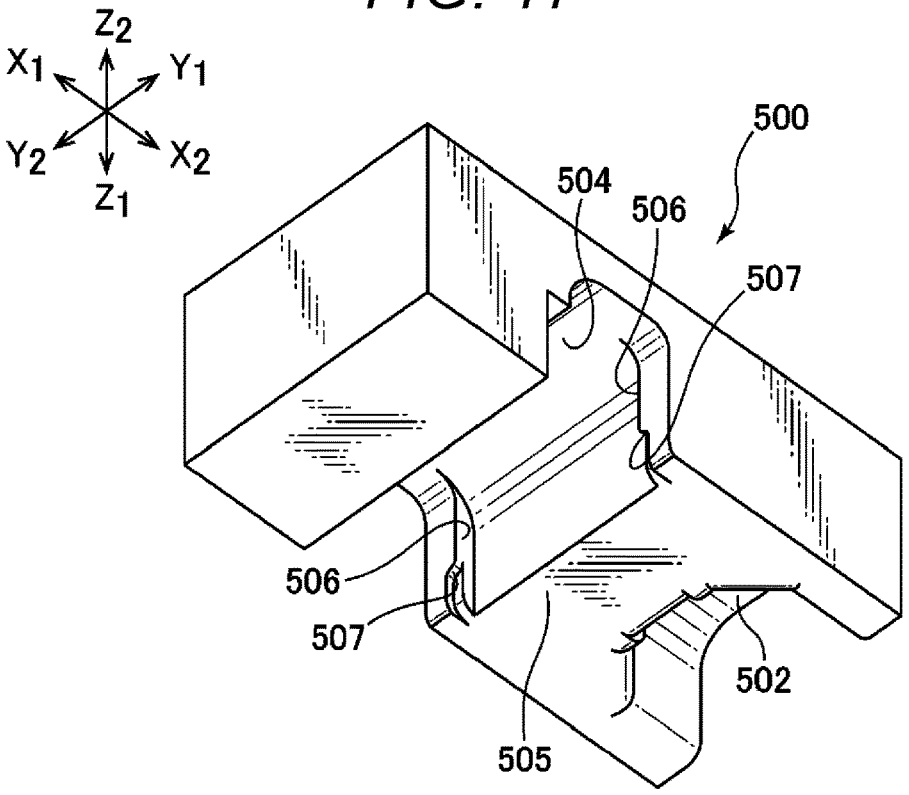
FIG. 17 is a perspective view of an inside of the upper mold according to the embodiment of the present disclosure.

Below (Z1 side) the first receptacle locking portion 154 which is the projecting portion of the receptacle additional member 150, there is an unfilled space 503 formed by a gap between the first receptacle fixing portion 156A and the bottom portion fixing wall 505. In order to suppress the inflow of the resin to the unfilled space 503 during insert molding, periphery of the unfilled space 503 is in close contact with an inner surface of the upper mold 500. FIG. 17 is a perspective view of an inside of the upper mold 500.

Figure 18:
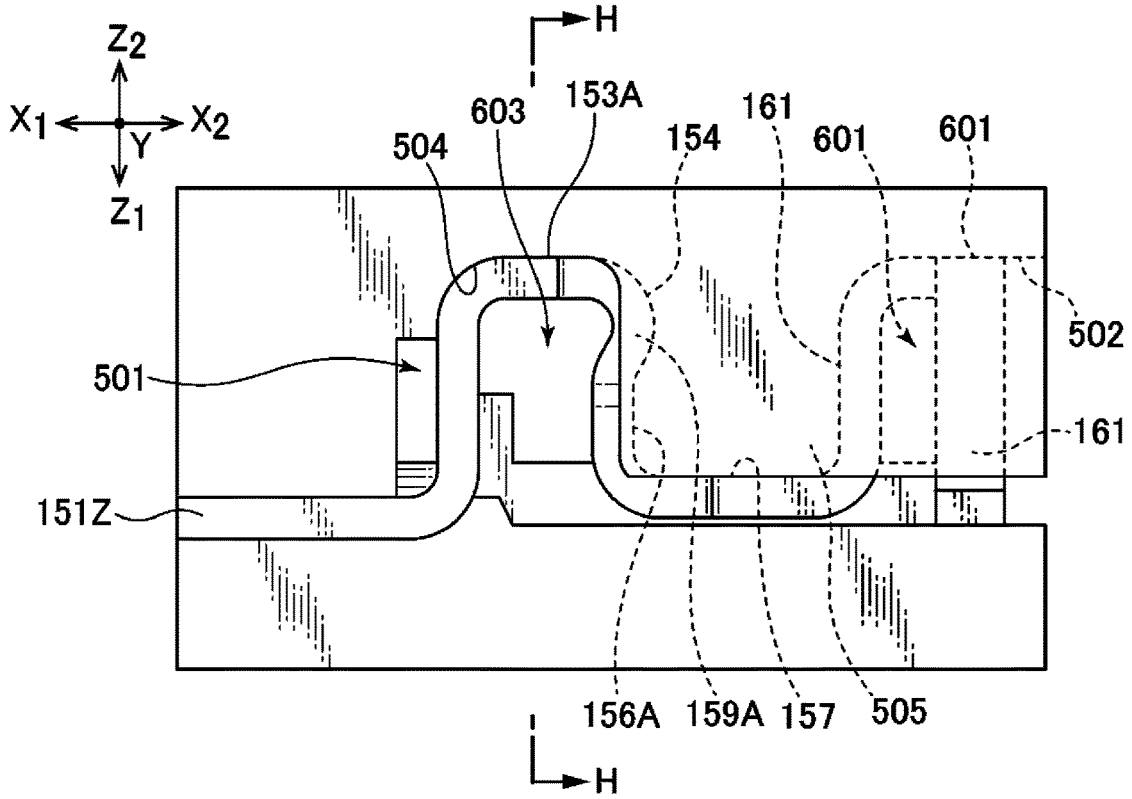
FIG. 18 is a side view illustrating a state in which the additional member placed on the lower mold illustrated in FIG. 14 is covered with the upper mold.

The upper mold 500 includes a side portion contact surface 506 and a shoulder portion contact surface 507 on the top portion contact surface 504 side (X1 side) of the bottom portion fixing wall 505 inside the upper mold 500. FIG. 18 is a side view illustrating a state in which the receptacle additional member 150 placed on the lower mold 600 illustrated in FIG. 14 is covered with the upper mold 500. Side surfaces of the first receptacle locking portion 154 and the first receptacle fixing portion 156A are in close contact with the side portion contact surface 506 and the shoulder portion contact surface 507 inside the upper mold 500.

Figure 19:
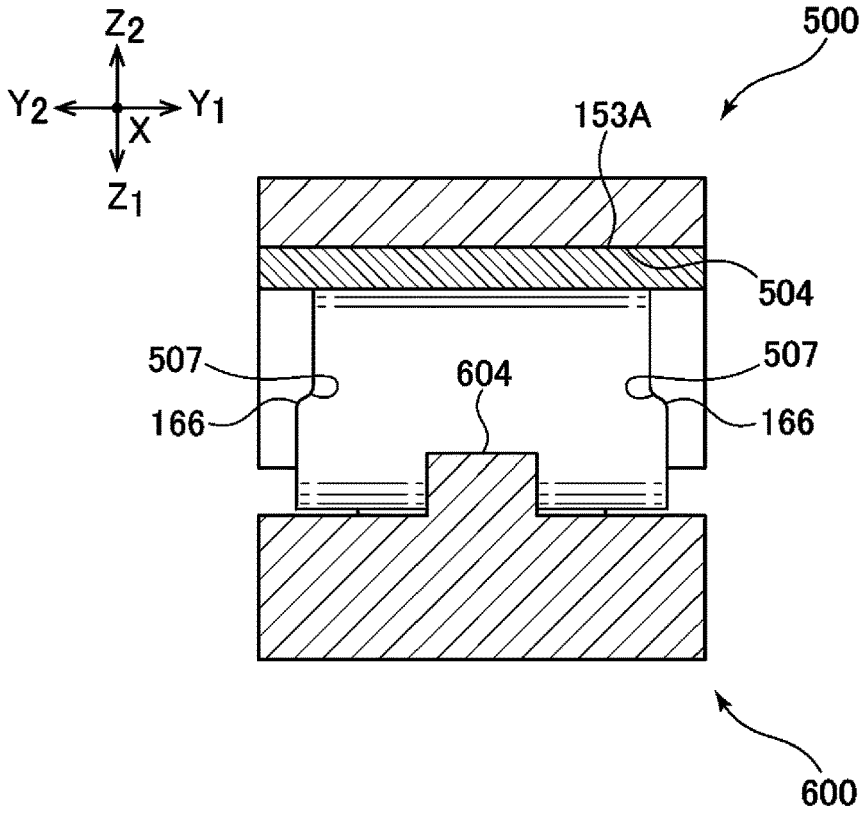
FIG. 19 is a cross-sectional view of the mold and the additional member taken along a line H-H illustrated in FIG. 18.

FIG. 19 is a cross-sectional view of the mold and the additional member taken along a line H-H illustrated in FIG. 18. FIG. 19 illustrates a state in which the side surfaces of the first receptacle locking portion 154 and the first receptacle fixing portion 156A are in close contact with the side portion contact surface 506 and the shoulder portion contact surface 507 inside the upper mold 500. The shoulder portion contact surface 507 contacts the shoulder portion 166 formed on a side surface between the first receptacle locking portion, which is the projecting portion of the receptacle additional member 150, and the receptacle fixing portion without any gap. Since the shoulder portion contact surface 507 contacts the shoulder portion 166 in this manner, the shoulder portion contact surface 507 pushes and fixes the receptacle additional member 150 to the bottom portion support surface 604 side (Z1 side).

Figure 20:
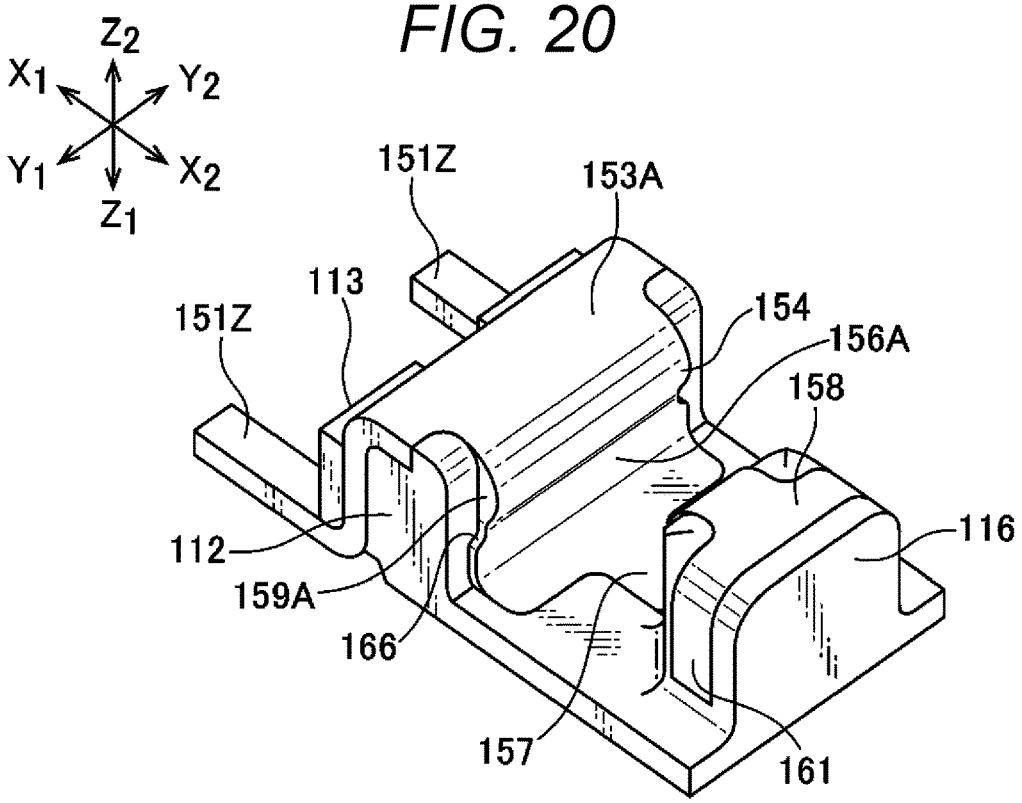
FIG. 20 is a perspective view of a part of the additional member held in the housing of the receptacle connector in a state where the mold is removed after insert molding according to the embodiment of the present disclosure.

FIG. 20 is a perspective view of a part of the additional member held in the housing of the receptacle connector in a state where the mold is removed after insert molding. By insert molding, the fitting protrusion 116 is formed inside the T-shaped portion 158 and the fitting portion fixing piece 161 of the receptacle additional member 150, and the bottom wall 119 is formed on a side surface and a back side of the bottom portion 157 of the receptacle additional member 150. Further, by insert molding, the first side wall portion 112 is formed on the back side of the first receptacle locking portion 154 and the top portion 153A of the receptacle additional member 150, and the peripheral wall portion 113 is formed on the outside (X1 side) of the first receptacle locking portion 154 and the top portion 153A. At least a part of the shoulder portion 166, which is pressed against the lower mold 600 side (Z1 side) in the fitting direction (Z-axis direction) by the shoulder portion contact surface 507 of the upper mold 500 during insert molding, is visible from the fitting direction (Z-axis direction) after insert molding (after removing the upper mold 500), and is exposed from the first side wall portion 112 toward the receiving portion 118.

The first receptacle fixing portion 156A of the receptacle additional member 150 is held by the first side wall portion 112 by embedding the back side and the side surface thereof in the first side wall portion 112 of the receptacle connector 100. Similarly, the first receptacle locking portion 154 is held by the first side wall portion 112 by embedding the back side and the side surface thereof in the first side wall portion 112. The first receptacle locking portion 154 is a projecting portion that projects from the first receptacle fixing portion 156A. A lateral width (width in the Y-axis direction) of the first receptacle fixing portion 156A is wider than that (width in the Y-axis direction) of the first receptacle locking portion 154. The first receptacle fixing portion 156A includes a pair of shoulder portions 166 on both side surfaces of the first receptacle fixing portion 156A. The shoulder portion 166 is provided on the side surface between the first receptacle fixing portion 156A and the first receptacle locking portion 154. That is, the first receptacle fixing portion 156A includes the pair of shoulder portions on both side surfaces between the first receptacle fixing portion 156A and the first receptacle locking portion 154. The shoulder portion 166 has a shape that makes the first receptacle fixing portion 156A wider than the first receptacle locking portion 154. For example, the shoulder portion 166 is formed in an inclined shape so as to increase the width of the first receptacle fixing portion 156A. The pair of shoulder portions 166 is formed on the same surface continuous with the receptacle locking side surface 159A. Note that the configuration of the second receptacle locking portion 155 and its surroundings can be the same as the configuration of the first receptacle locking portion 154 and its surroundings illustrated in FIG. 20.

Figure 21:
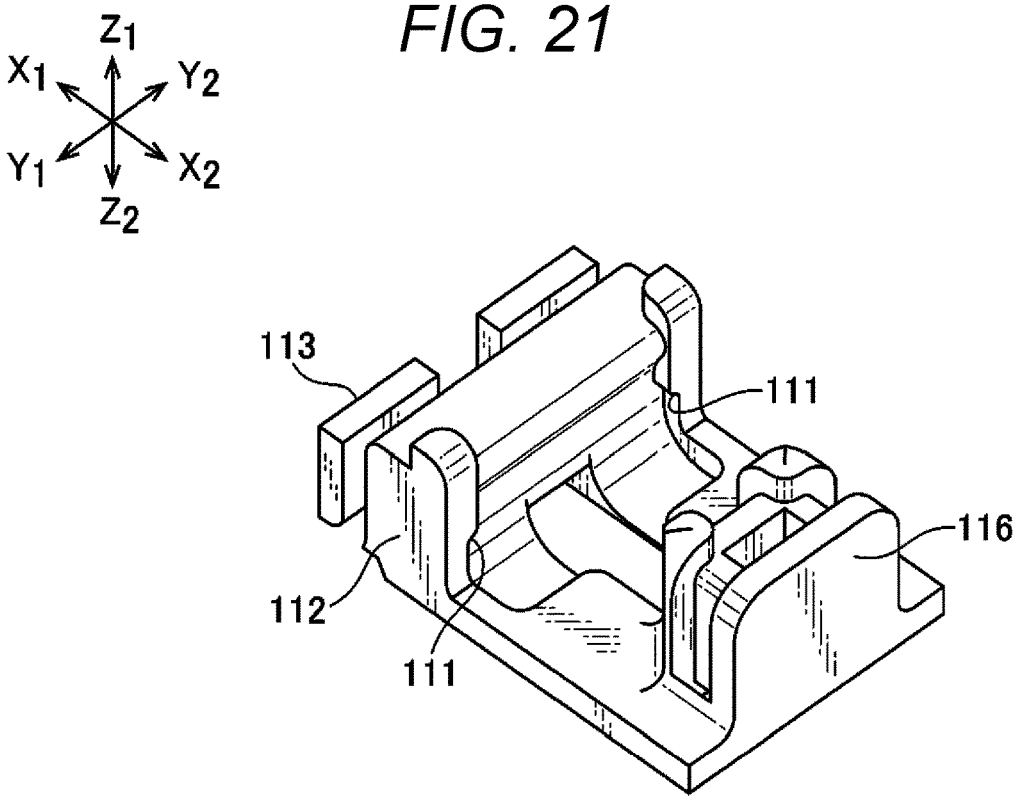
FIG. 21 is a perspective view of a part of the housing in a state where the additional member which is a fitting is removed from FIG. 20.

FIG. 21 is a perspective view of a part of the housing in a state where the additional member which is the fitting is removed from FIG. 20. The first side wall portion 112 has a shoulder portion contact surface 111 formed to be fitted to a shape of the shoulder portion 166 provided on the side surface between the first receptacle locking portion 154 which is the projecting portion and the first receptacle fixing portion 156A. The shoulder portion contact surface 111 is in close contact with a surface of the shoulder 166.

The embodiment illustrated in FIGS. 12 to 21 is a configuration example of the first receptacle locking portion 154 of the receptacle additional member 150. However, the embodiment is not limited to the configuration example. For example, the fittings such as the second receptacle locking portion 155 or the receptacle terminal 120 of the receptacle additional member 150 may be configured to have a shoulder portion in the same manner as the first receptacle locking portion 154, and the insert molding can be performed in the same manner.

In the insert molding manufacturing process illustrated in FIGS. 12 to 21, first, the receptacle additional member 150, which is the fitting, is placed on the lower mold 600 by the fixing jig. Subsequently, the lower mold 600 on which the receptacle additional member 150 is placed is covered with the upper mold 500 configured to be able to house the receptacle additional member 150 therein. Thus, the receptacle additional member 150 is placed inside the upper mold 500, and the shoulder portions 166 of the receptacle additional member 150 are pressed by the shoulder portion contact surface 507 of the upper mold 500. Subsequently, the insulating resin for forming the housing is injected into a space between the lower mold 600 and the upper mold 500, and then the injected resin is cured to form the housing. Finally, the upper mold 500 and the lower mold 600 are removed, and the receptacle housing 110 holding the receptacle additional member 150 formed by curing the resin is taken out.

Such a manufacturing process can be performed not only in the receptacle connector but also in the plug connector. That is, the shoulder portions can be provided on the plug additional member of the plug connector, and the same insert molding manufacturing process can be performed.

Figure 22:
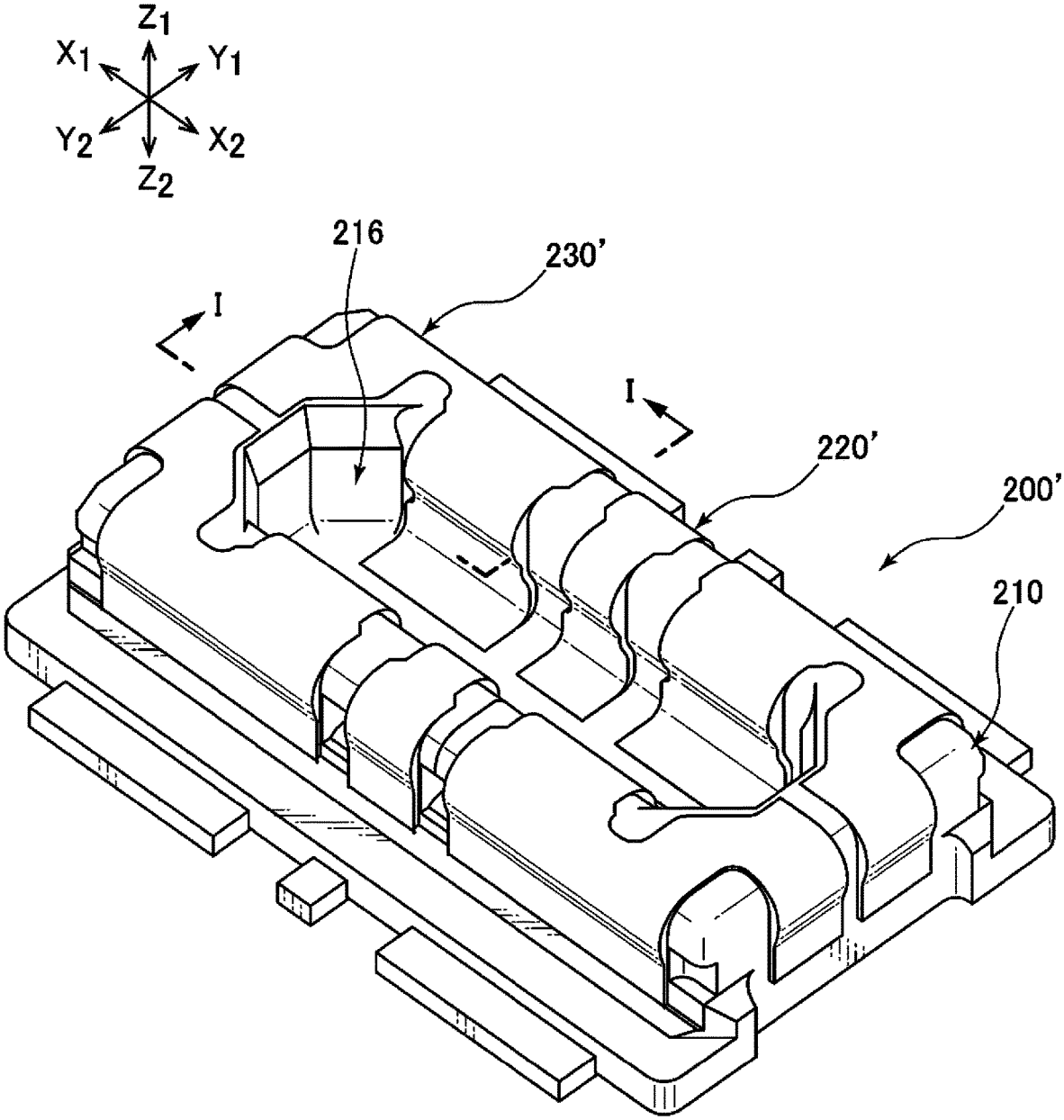
FIG. 22 is a perspective view of an appearance of the plug connector according to another embodiment of the present disclosure.
Figure 23:
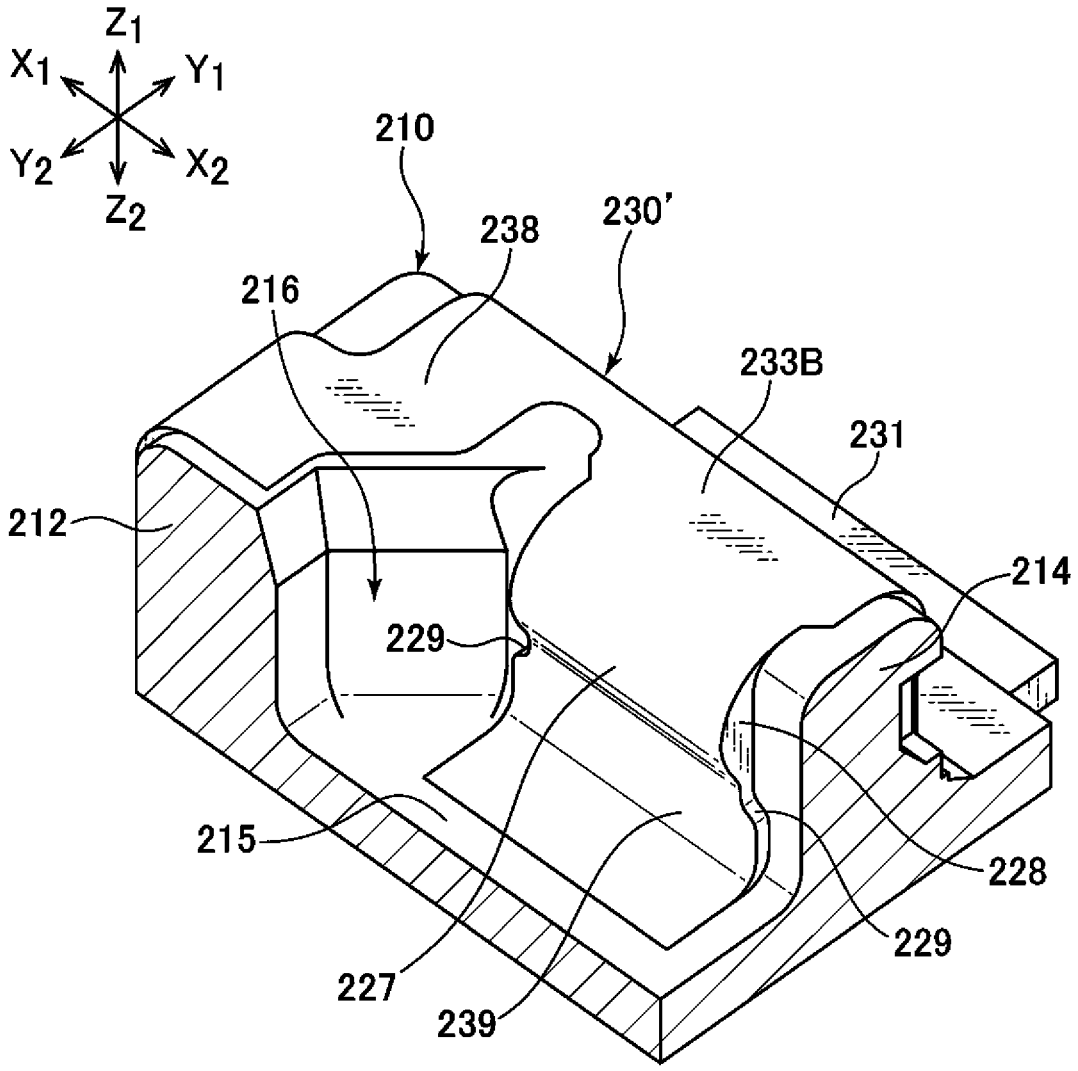
FIG. 23 is a perspective view of a cross-section of a part of the additional member of the plug connector taken along a line I-I illustrated in FIG. 22.
Figure 24:
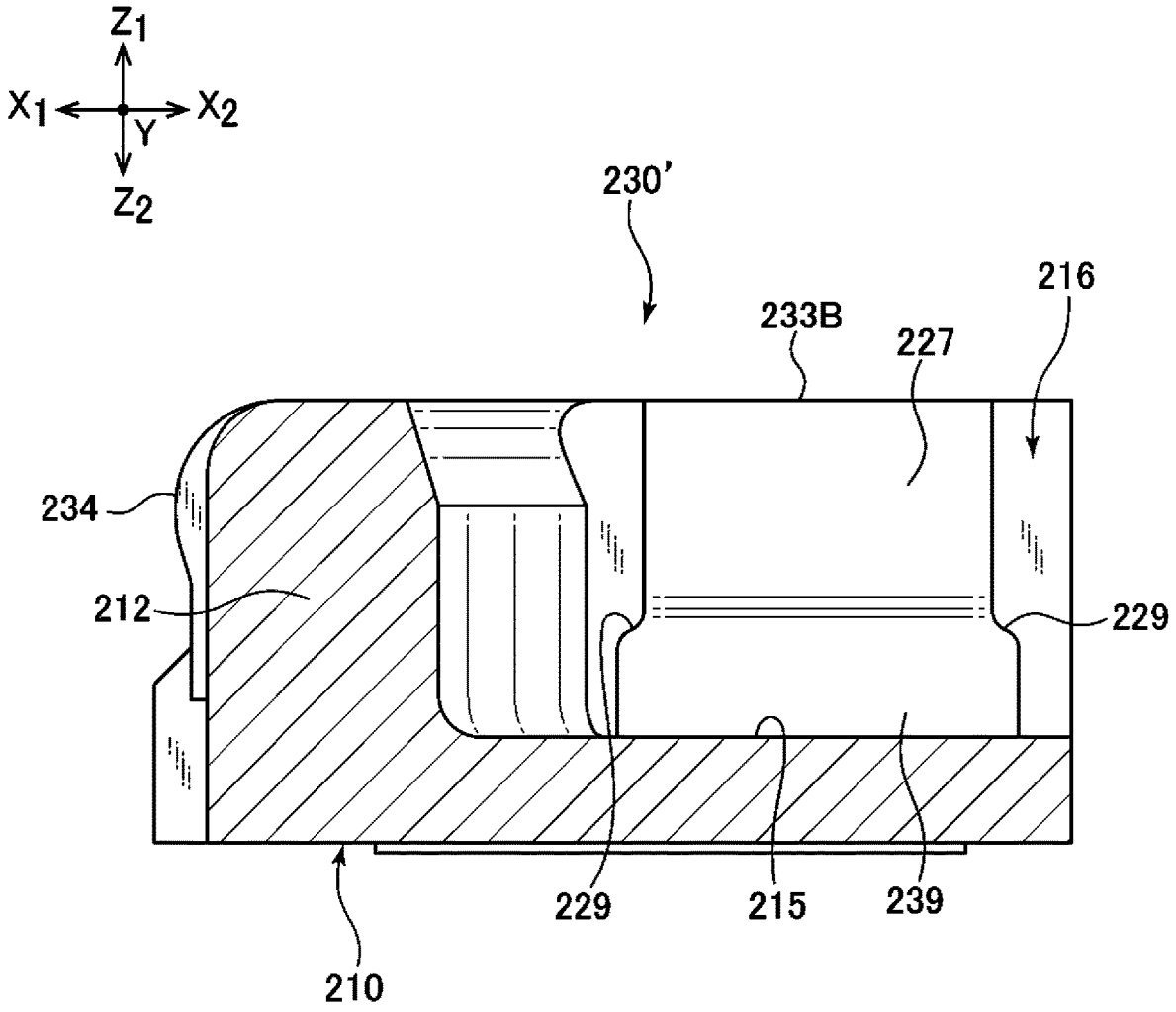
FIG. 24 is a side view of the cross-section of the part of the additional member of the plug connector taken along the line I-I illustrated in FIG. 22.

FIG. 22 is a perspective view of the appearance of the plug connector according to another embodiment of the present disclosure. Basic configuration of the plug connector 200' according to another embodiment is the same as that of the plug connector 200 according to the above-described embodiment, and the members having substantially different shapes are a plug terminal 220' and a plug additional member 230'. The plug connector 200' includes the plug housing 210, the plug terminal 220', and the plug additional member 230'. The plug additional member 230' includes the same configuration as the shoulder portions 166 of the receptacle additional member 150. FIG. 23 is a perspective view of a cross-section of a part of the plug additional member 230' taken along a line I-I illustrated in FIG. 22. FIG. 24 is a side view of the cross section of the part of the plug additional member 230' taken along the line I-I illustrated in FIG. 22.

The plug housing 210 includes the fitting recess 216 formed as a space between a pair of first side wall portions 212 and a pair of second side wall portions 214, and the substrate side (Z2 side) of the fitting recess 216 is blocked by a bottom wall 215. That is, the fitting recess 216 (receiving portion) is formed as a space defined by the first side wall portions 212, the second side wall portions 214, and the bottom wall and opened to the fitting side (Z1 side) with the mating connector. The plug terminal 220' and the plug additional member 230' are provided by insert molding (integral molding) with the plug housing.

Basic configuration of the plug additional member 230' is the same as that of the receptacle additional member 150. The plug additional member 230', which is the fitting to be insert-molded, includes a plug fixing portion 239 provided on the second side wall portion 214 of the plug connector 200' and a projecting portion 227 also provided on the second side wall portion 214. A lateral width of the plug fixing portion 239 (width in the Y-axis direction) is wider than that (width in the Y-axis direction) of the projecting portion 227. The plug fixing portion 239 includes a pair of shoulder portions 229 on both side surfaces of the plug fixing portion 239. The shoulder portions 229 are provided on the side surface between the plug fixing portion 239 and the projecting portion 227. That is, the plug fixing portion 239 includes the pair of shoulder portions on both side surfaces between the plug fixing portion 239 and the projecting portion 227. The shoulder portions 229 have a shape that makes the plug fixing portion 239 wider than the projecting portion 227. For example, the shoulder portion 229 is formed in an inclined shape so as to increase the width of the plug fixing portion 239. The projecting portion 227 includes a protrusion side surface 228 exposed from the second side wall 214. The shoulder portion 229 is formed on the bottom wall 215 side (Z2 side) of the protrusion side surface 228. The protrusion side surface 228 and the shoulder 229 are continuous surfaces. That is, the pair of shoulder portions 229 is formed on the same surface continuous with the protrusion side surface 228. The shoulder portion 229 has the same configuration as the shoulder portion 166, and at least a part of the shoulder portion 229 is visible from the fitting direction (Z-axis direction), and is exposed toward the fitting recess 216 (receiving portion) from the second side wall portion 214.

Another embodiment of the present disclosure illustrated in FIGS. 22 to 24 is a configuration example of a portion held by the second side wall portion 214 of the plug additional member 230'. However, another embodiment is not limited to this configuration example. For example, the fitting such as a portion held by the first side wall portion 212 or the plug terminal 220' of the plug additional member 230' is configured to be provided with a shoulder portion in the same manner as the portion held by the second side wall portion 214, and the insert molding can be performed in the same manner.

As described above, the connector according to the embodiment of the present disclosure includes the shoulder portion in the fitting such as a terminal or an additional member, for insert molding. The connector according to the embodiment of the present disclosure is manufactured by insert molding in a state where the shoulder portion is pressed by the upper mold and the fitting is fixed to the lower mold. During insert molding, the shoulder portion functions as the protrusion suitable for support by the mold, the fixing jig, or the like, so that the fitting can be sufficiently supported without any gap. Therefore, it is possible to suppress the inflow of the resin which is the insulator to the unintended portion during insert molding.

The individual embodiments of the present disclosure are not independent and can be appropriately implemented in combination with each other.

The connector according to the present disclosure can be used for applications such as connecting the substrates with the flat cable in the electronic device such as a smartphone or a mobile phone that transmits electric signals at high speed.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A connector fitting comprising:

a fixed portion provided on a side wall of a housing of a connector; and a projecting portion provided on the side wall of the housing and projecting from the side wall of the housing with respect to the fixed portion, wherein the fixed portion is wider than the projecting portion, the fixed portion includes a pair of shoulder portions on both side surfaces of the fixed portion, the shoulder portions are provided on a side surface between the fixed portion and the projecting portion, and the fixed portion and the projecting portion are in direct contact with the side wall of the housing.

2. The connector fitting according to claim 1, wherein the shoulder portion is formed in an inclined shape so as to increase a width of the fixed portion.

3. A connector terminal made of the connector fitting according to claim 1, further comprising:

a movable portion including a movable contact that is a contact point with a mating terminal of a mating connector; and a bottom portion that connects the movable portion and the fixed portion, wherein the projecting portion faces the movable portion and functions as a fixed contact that is a contact point with the mating terminal of the mating connector.

4. A connector additional member made of the connector fitting according to claim 1, further comprising a first locking portion and a second locking portion, wherein the projecting portion is at least one of the first locking portion and the second locking portion, and the first locking portion includes the second locking portion extending in a direction perpendicular to the first locking portion, on both sides of the first locking portion.

5. A connector comprising:

the connector fitting according to claim 1; and a housing, wherein the housing includes a side wall portion, a bottom wall, and a receiving portion formed of the side wall portion and the bottom wall, and a part of the connector fitting is embedded in the side wall portion, and at least a part of a side surface of the connector fitting is exposed from the side wall portion toward the receiving portion.

6. The connector according to claim 5, wherein at least a part of the shoulder portion is visible from a mating direction with a mating connector.

7. A receptacle connector comprising:

a plurality of receptacle terminals;

a receptacle additional member for maintaining a fitting state with a mating connector; and a receptacle housing, wherein the receptacle housing includes a first side wall portion and a second side wall portion, the first side wall portion being arranged in a direction perpendicular to the second side wall portion, the receptacle additional member includes: a first receptacle fixing portion provided on the first side wall portion; a first receptacle locking portion provided on the first side wall portion and projecting from the first side wall portion toward inside the receptacle housing with respect to the first receptacle fixing portion; a second receptacle fixing portion provided on the second side wall portion; and a second receptacle locking portion provided on the second side wall portion and projecting from the second side wall portion toward inside the receptacle housing with respect to the second receptacle fixing portion, the first receptacle fixing portion is wider than the first receptacle locking portion, the second receptacle fixing portion is wider than the second receptacle locking portion, the first receptacle fixing portion includes a pair of shoulder portions on both side surfaces between the first receptacle fixing portion and the first receptacle locking portion, the second receptacle fixing portion includes a pair of shoulder portions on both side surfaces between the second receptacle fixing portion and the second receptacle locking portion, the receptacle additional member includes the second receptacle locking portion extending in a direction perpendicular to the first receptacle locking portion, on both sides of the first receptacle locking portion, the first receptacle fixing portion and the first receptacle locking portion are in direct contact with the first side wall portion of the receptacle housing, and the second receptacle fixing portion and the second receptacle locking portion are in direct contact with the second side wall portion of the receptacle housing.

8. A plug connector comprising:

a plurality of plug terminals;

a plug additional member for maintaining a fitting state with a mating connector; and a plug housing, wherein the plug housing includes a first side wall portion and a second side wall portion, the plug additional member includes a plug fixing portion provided on the second side wall portion and a projecting portion provided on the second side wall portion and projecting from the second side wall portion with respect to the plug fixing portion, the plug fixing portion is wider than the projecting portion, the plug fixing portion includes a pair of shoulder portions on both side surfaces between the plug fixing portion and the projecting portion, and the plug fixing portion and the projecting portion are in direct contact with the second side wall portion of the plug housing.

9. A connector manufacturing method for manufacturing the connector according to claim 5, comprising the following steps of:

placing the connector fitting on a lower mold by a fixing jig;

covering the lower mold, on which the connector fitting is placed, with an upper mold configured to be able to house the connector fitting therein, thereby placing the connector fitting inside the upper mold, and pressing the pair of shoulder portions of the connector fitting by the upper mold;

injecting an insulating resin for forming the housing into a space between the lower mold and the upper mold;

curing the resin; and removing the upper mold and the lower mold, and taking out the housing that is formed by curing the resin and holds the connector fitting.

* * * * *